US007241162B1

(12) United States Patent
Lawrence

(10) Patent No.: US 7,241,162 B1
(45) Date of Patent: Jul. 10, 2007

(54) MODULAR PLUG CONNECTOR

(75) Inventor: Michael E. Lawrence, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/426,069

(22) Filed: Jun. 23, 2006

(51) Int. Cl.
*H01R 4/24* (2006.01)

(52) U.S. Cl. ..... 439/418

(58) Field of Classification Search ..... 439/417, 439/418, 419, 391, 392, 577
See application file for complete search history.

(56) References Cited

U.S. PATENT DOCUMENTS 5,681,182 A * 10/1997 Reichle ..... 439/417
6,604,957 B2 * 8/2003 Comini ..... 439/417
6,729,900 B2 * 5/2004 Dooley ..... 439/417
7,140,906 B2 * 11/2006 Takahashi ..... 439/418

* cited by examiner

*Primary Examiner*—Phuong Dinh
(74) *Attorney, Agent, or Firm*—Schmeiser, Olsen & Watts

(57) ABSTRACT

A modular connector comprising a connector body where at least one terminal member disposed in the connector body, wherein each of the terminal members has a blade, and a contact face. A wire loader is configured for sliding engagement within the connector body. The wire loader having at least one hole corresponding to the terminal member. The hole is dimensioned therein to let an insulated wire be inserted therethrough, wherein when the wire loader is slidably disposed within the connector body, the inserted wire is positioned to be in contact with the blade so the blade is pressed into electrical communication with the at least one terminal member.

20 Claims, 23 Drawing Sheets

MODULAR PLUG CONNECTOR

FIELD OF THE INVENTION

The field of electrical connectors for transmission of data between sources.

BACKGROUND

Communication cables and in particular data cables used for the transmission of information according to the Ethernet standard are commonplace and used in a multitude of environments including commercial offices and buildings, industrial environments, and with increasing frequency, residences. The data cables most commonly used are generally referred to as twisted wire pairs. A typical data cable contains two connectors on both ends to connect a computer to another computer or network device.

The typical connector may be for applications such as ethernet, which uses data cables having twisted pairs of wires within to minimize interference or cross-talk between the individual wires in the cable, which may be required to travel relatively long distances. To prevent unwanted interference in the wires, the length of untwisted wires before entering the connector were kept to a minimum, typically only 0-2 inches long. The short untwisted wire lengths were then inserted into connectors having an insulation displacement contact (IDC) that typically required special tools to compress. Furthermore, the very short wire segments made the risk of switching the wire order unintentionally very high leading to the creation of defective connectors. Additionally, the short wire segments and the typical style IDC made the chance of bad connections a common problem. These deficiencies required testing of all cables a requirement to avoid problems associated with the old style common connector. The instant invention addresses the aforementioned deficiencies with a new novel connector system.

SUMMARY OF THE INVENTION

A first aspect of the present invention provides a modular connector insulation displacement contact comprising: an electrically conductive body configured to be mounted within a modular connector, said body having a first surface and a second surface, said body further including: A) a connector terminal positioned on the first surface of the body, wherein said terminal is configured to transmit an electrical signal;

B) a stripping blade angularly protruding from between the first surface and the second surface of the body, said stripping blade configured to strip insulation of a wire compressively slid upon said blade and electrically expose a conductive element of the wire; and C) a wire contact positioned at the second surface of the body adjacent the stripping blade, wherein said contact is configured to receive electrical signals from said exposed conductive element of said wire when said exposed conductive element of said wire is compressed against said contact.

A second aspect of the present invention provides a modular connector comprising a connector body; at least one terminal member disposed in said connector body, wherein said at least one terminal member has a blade, and a contact face; and a wire loader configured for sliding engagement within the connector body, said wire loader having at least one hole corresponding to said terminal member, said hole dimensioned therein to let an insulated wire be inserted therethrough, wherein when said wire loader is slidably disposed within the connector body, the inserted wire is positioned to be in contact with said blade so the blade is pressed into electrical communication with the at least one terminal member.

A third aspect of the present invention provides a modular connector comprising: a connector body; a compressive insert wherein said insert is slidably disposed within the connector body; at least one hole within the compressive insert that is dimensioned to receive an insulated wire; at least one alignment groove adjacent to the at least one hole, said groove dimensioned to receive the insulated wire; and at least one contact member, said contact member having at least one blade and at least one terminal, said contact member is positioned within the main connector body adjacent said compressive insert, wherein said compressive insert compresses the insulated wire against the contact.

A forth aspect of the present invention provides a modular ethernet connector comprising: a connector body; an insert slidably disposable within the connector body; at least eight holes within the insert, wherein said insert is dimensioned to receive a wire having a jacket; at least eight alignment grooves adjacent to each of the at least eight holes, said grooves dimensioned to receive the wire having the jacket; a contact terminal, said terminal positioned within said connector body; and at least one means for electrically connecting the contact terminal to the wire having the jacket.

A fifth aspect of the present invention provides a method of forming a cable from a wire and a modular connector comprising: providing a cable having at least one insulated wire; providing a connector body having a chamber; providing a wire loader having at least one hole, said hole dimensioned therein to let the at least one insulated wire pass therethrough; providing at least one groove adjacent the at least one hole, said groove positioning the least one insulated wire; inserting the at least one insulated wires through the at least one hole and into the at least one groove; and compressing the loader into the connector to make an electrical connection with the at least one insulated wire.

BRIEF DESCRIPTION OF THE DRAWINGS

Some embodiments of this invention will be described in detail, with reference to the following figures, wherein like designations denote like members, wherein.

DETAILED DESCRIPTION OF THE INVENTION

Figure 1:
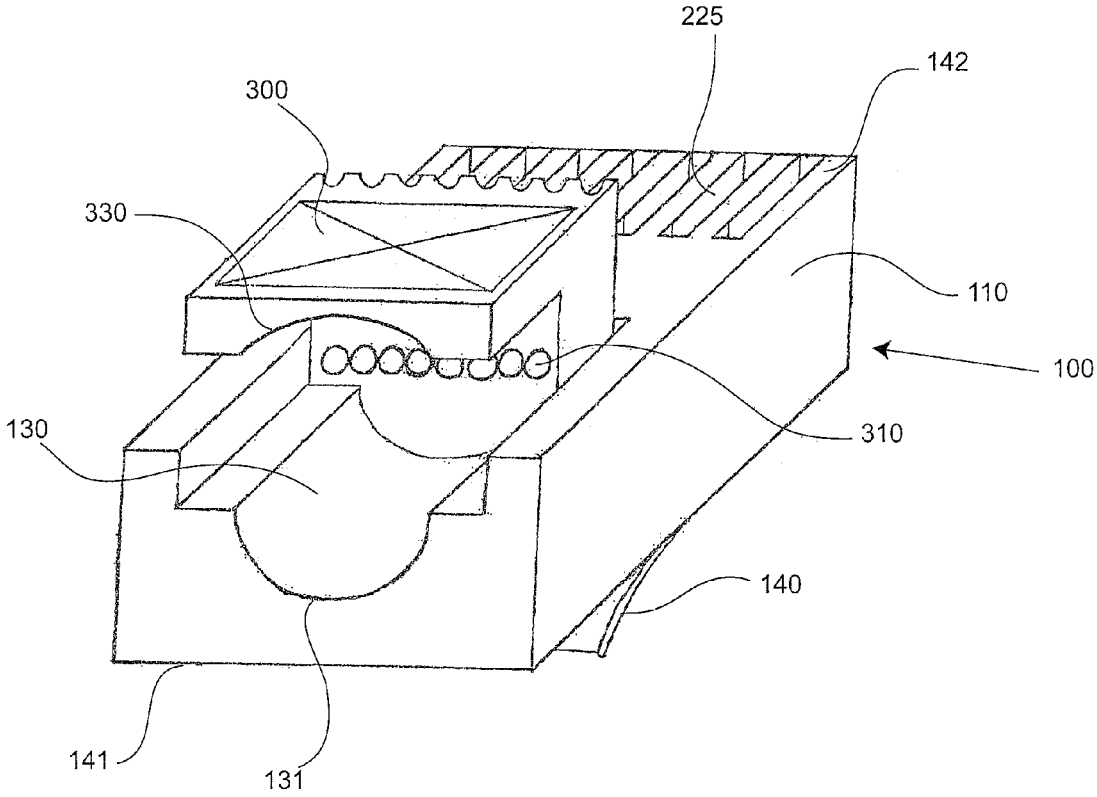
FIG. 1 shows a view of an embodiment of the cable connector in an unassembled state.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

With reference to the drawings, q connector body 110, 410 may utilize a component system to quickly produce a connector 100, 400 that may not require any tools for assembly and reduce the necessity for connectivity testing as shown in FIGS. 1-23. The component system may help to rapidly align and visually confirm the order of the twisted wire pairs from a cable before being made into the connector 100, 400. Once the wiring order has been confirmed then the wires may be compressed within the connector 100, 400 making an electrical connection without tools.

Figure 6:
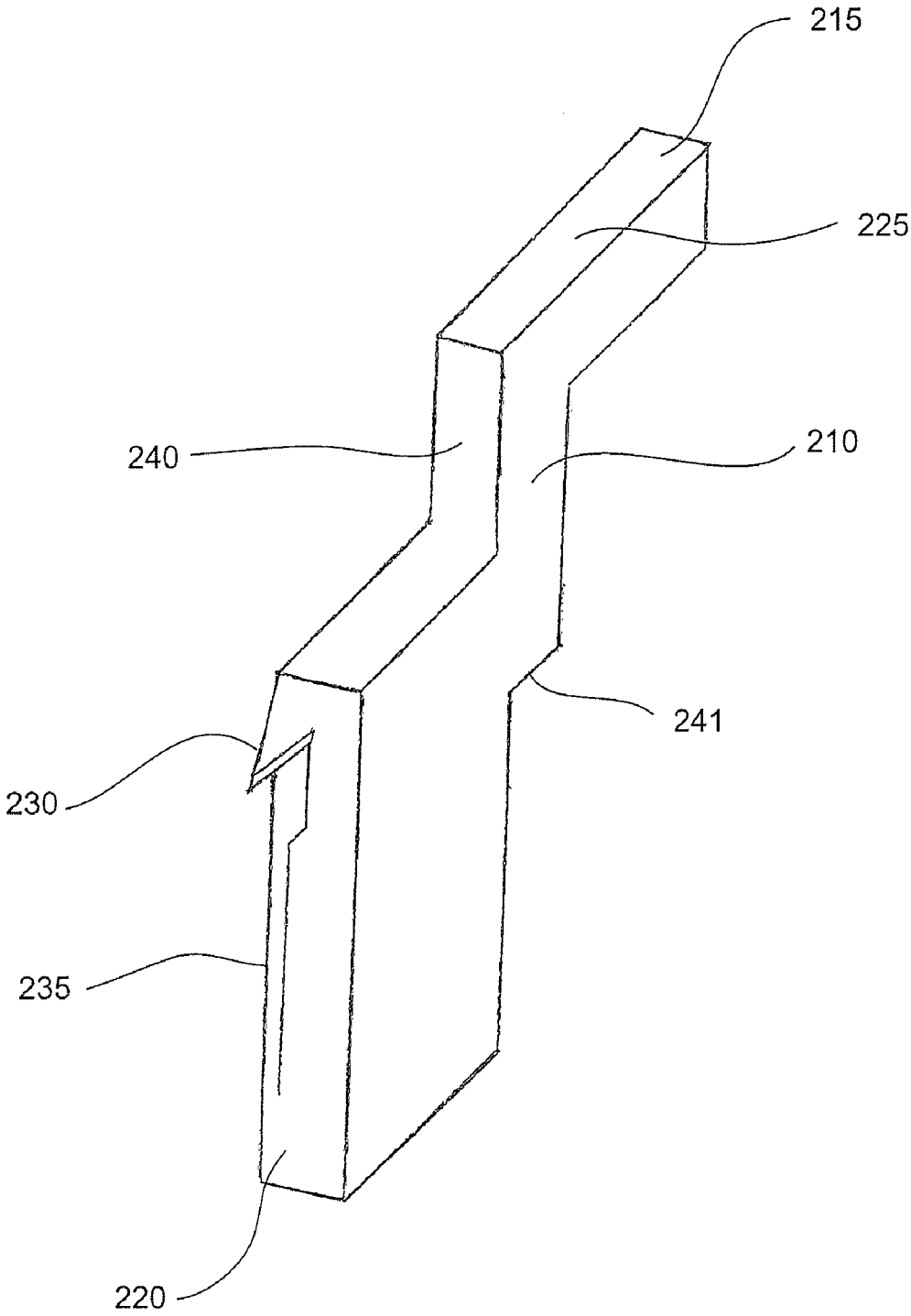
FIG. 6 illustrates a perspective view of an embodiment of the cable connector's one piece IDC, which acts as the wire shearing and contact point as well as the terminal contact for the connector.
Figure 7:
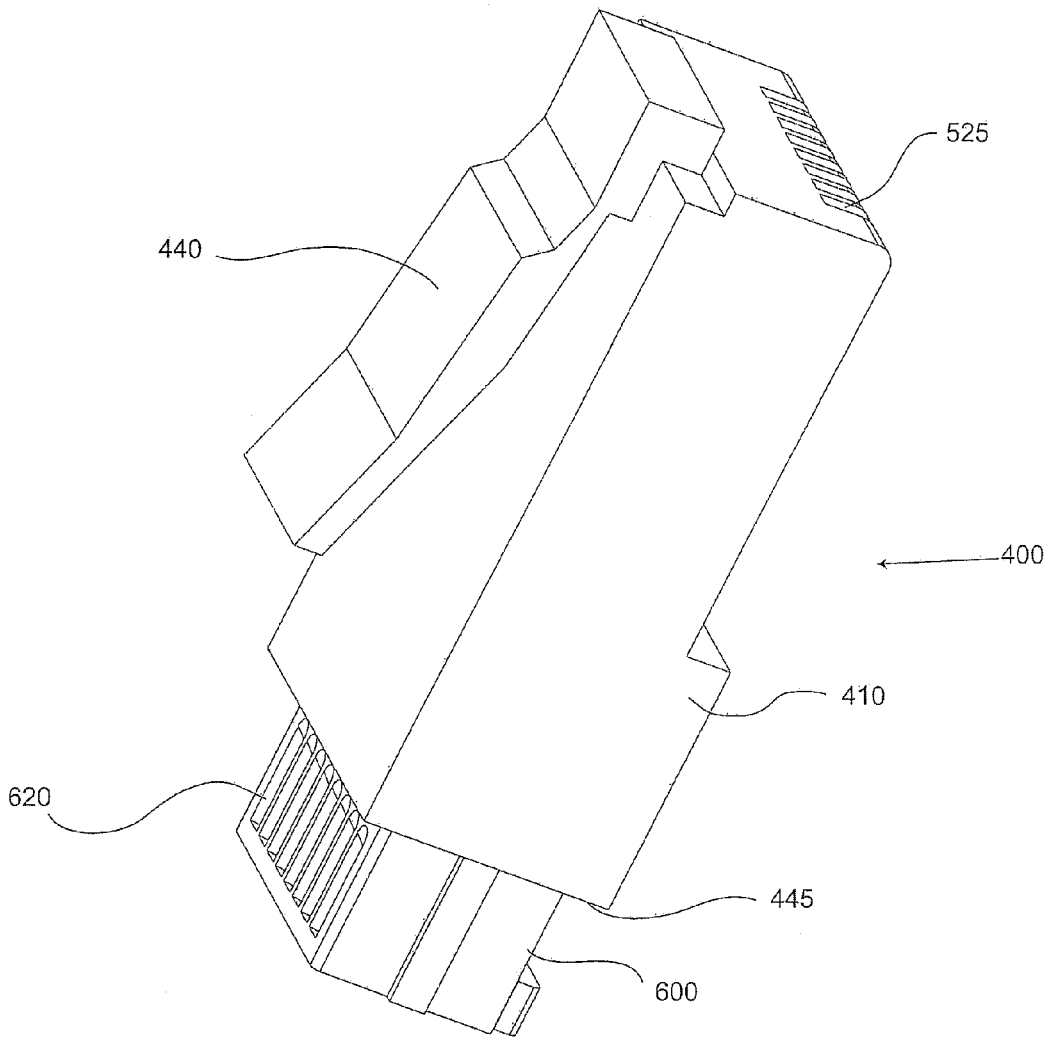
FIG. 7 shows a perspective view of an embodiment of a connector in a partially assembled state.
Figure 8:
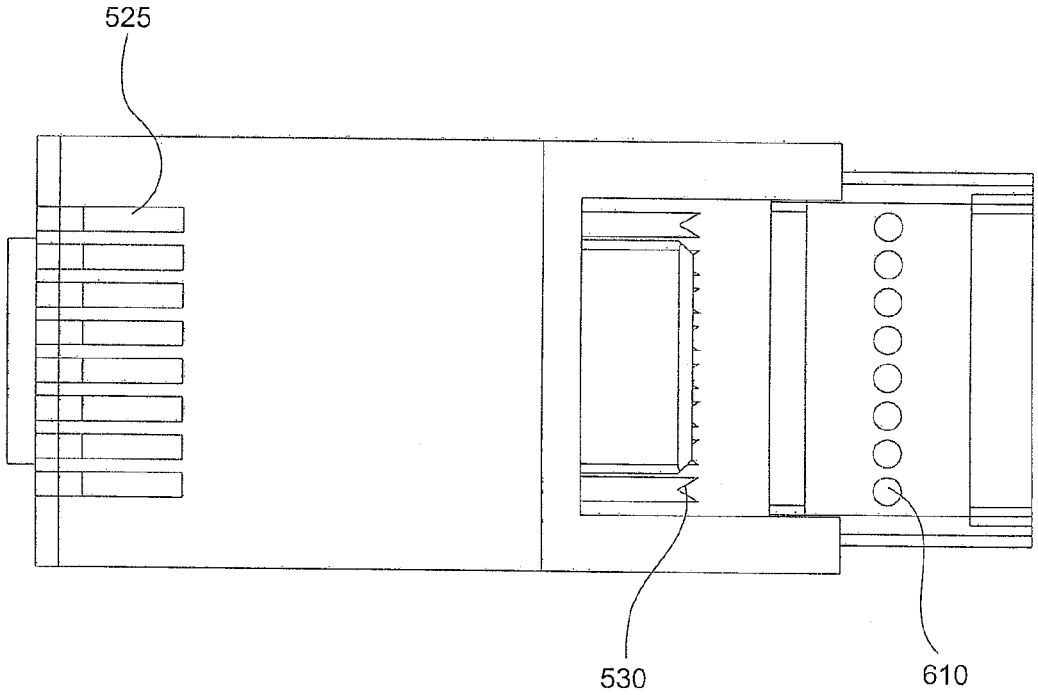
FIG. 8 shows of bottom view of an embodiment of a connector in a partially assembled state.

A modular connector insulation displacement contact 200, as shown in FIG. 6, facilitates the formation of a modular connector 100 without requiring any tools. The modular connector insulation displacement contact 200 comprises an electrically conductive body 210 configured to be mounted within a modular connector 100, said body 210 having a first surface 215 and a second surface 220. The modular connector 100 may be made of any relatively dimensionally stable material that has insulative properties. One satisfactory material is a plastic based material that may be injection molded to the desired configuration while retaining good dimensional stability. The connector body 210 could be made out of several pieces and assembled into a larger assembly or it could be made into a larger one piece assembly with items such a connector terminal 225 that may be molded directly into the body 210 as an injection molding insert.

The body 210 may further include a connector terminal 225 positioned on the first surface 215 of the body 210, wherein the terminal 225 configured to transmit an electrical signal through contact. To assist in the making of an electrical connection without tools, the electrically conductive body 210 may have a stripping blade 230 angularly protruding from between the first surface 215 and the second surface 220 of the body 210. The stripping blade 230 may be configured to strip insulation off of a wire 12 compressively slid upon said blade 230 and electrically expose a conductive element 20 of the wire 12. The stripping blade 230 may be angled 1-20 degrees or even 1-90 degrees above the plane of the second surface 220. The stripping blade 230 may be designed to be stationary with respect to a wire 12 so that when the wire 12 is dragged along insulation 12 the conductive element 20 may be exposed.

A wire contact 235 may be positioned at the second surface 220 of the body 210 adjacent the stripping blade 230. The contact 235 may be configured to receive electrical signals from said exposed conductive element 20 of said wire 12 when said exposed conductive element 20 of said wire 12 is compressed against said contact 235. The shearing blade(s) 230 allows the stripped wire 20 to have a long strip or extended region that may lie firmly against the metal contact 210, forming a very ample surface area contact 235. The modular connector insulation displacement contact 200 may also include a locking step 240 positioned between the first surface 215 and the second surface 220 that may box in the connector terminal 225 to ensure dimensional stability of the connector 100. The compression of the stripped wire 20 against the contact 235 sandwiches or "boxes in" a broad section of the wire against the contact 235 instead of a single point of a wire tip that may pull out from the contact.

FIG. 6 shows a first 215 and a second surface 220 that may be located at substantially right angles to each other, but can also be located at angles with respect to each other ranging from 0-180 degrees. Thus, the terminal 225 could be on one side of the insulation displacement contact 200 and the blade 230 adjacent a contact 235 could be on the opposite side. A first geometric plane 215 may correspond to the terminal 225 of the electrically conductive body 210 that may lie in or run contiguous with the first surface 215. A second geometric plane 220 may correspond to the wire contact 235 that may lie in or run contiguous with the second surface 220. An intersection of the first geometric plane 215 and the second geometric plane 220 may correspond to a position of the blade 230. The blade 230 may be positioned adjacent the contact surface 235 to remove insulation from a wire 12. The intersection of the planes may form an angle of 10-170 degrees. The angle between the geometric planes 215, 220 would also determine the angle at which a wire holder 300 or compression insert 600 would be positioned in the connector body 110, 410.

Figure 5:
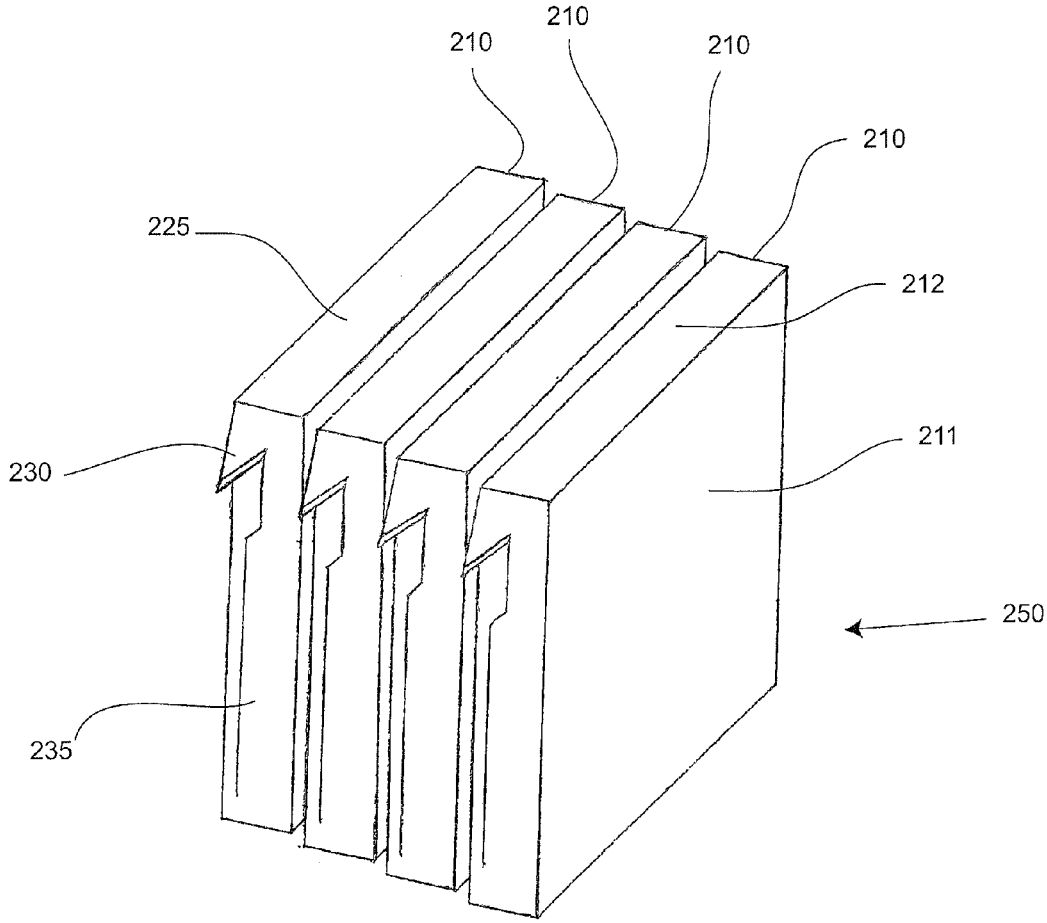
FIG. 5 illustrates a perspective view of an embodiment of the cable connector's Insulation Displacement Contacts (IDC s)

The modular connector insulation displacement contact 200 may assist the production of a connector 100 without tools when the displacement contact 200 is installed in a connector body 110. As shown in FIG. 5, a contact bank 250 may include at least two or more electrically conductive bodies 210, said electrically conductive bodies 210 being arranged linearly in parallel with each other. The electrically conductive bodies 210 are arranged so they will not touch each other, and therefore the bodies 210 may be parallel so that each terminal 225 is adjacent to another terminal 225, each contact 235 is adjacent to another contact 235 and each blade 230 is adjacent to another blade 230. The contact bank 250 may be alternatively a solid body 211 having a plurality of conductive surfaces 212 arranged in parallel attached thereupon. The conductive surfaces 212 each may have a terminal 225, a blade 230 and a contact 235.

Figure 3:
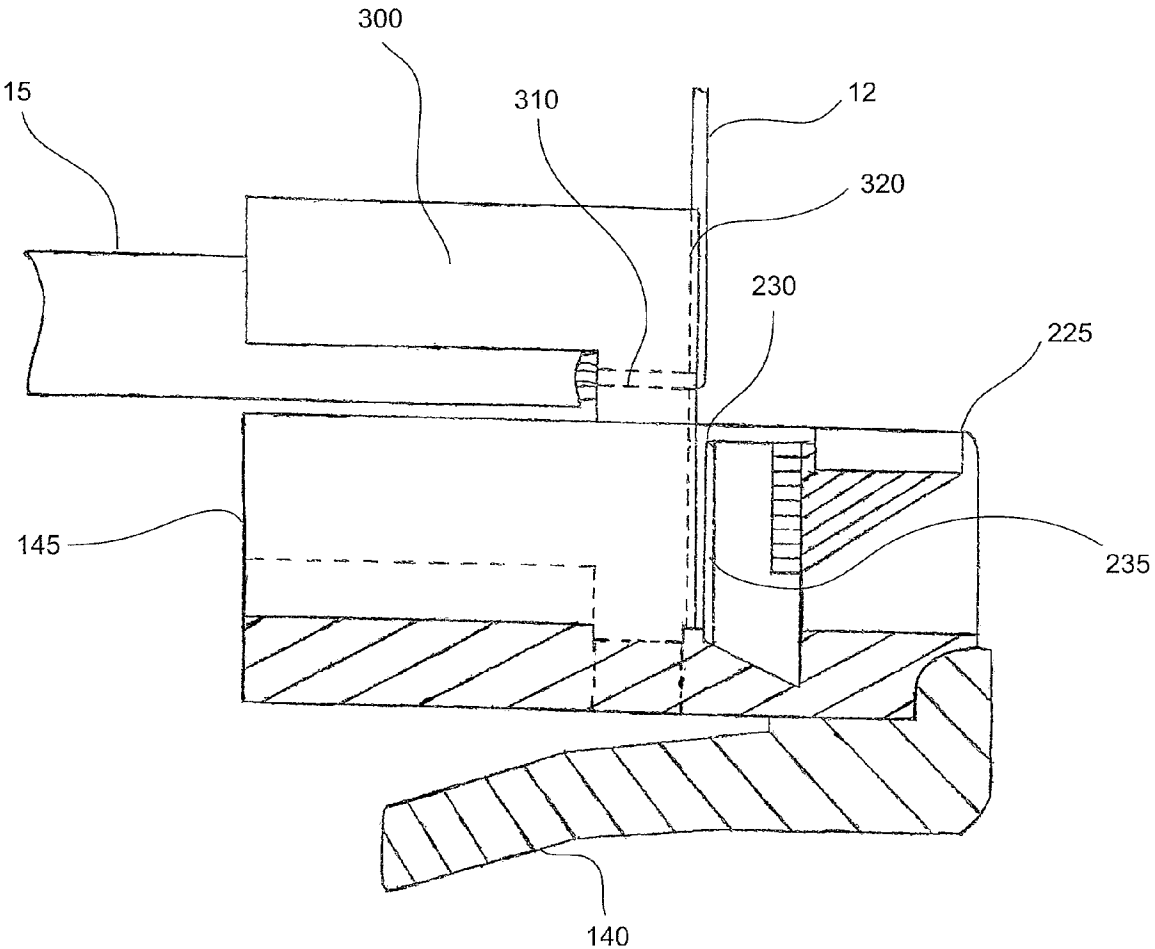
FIG. 3 illustrates a side view of an embodiment of the cable connector in a partially assembled state.
Figure 4:
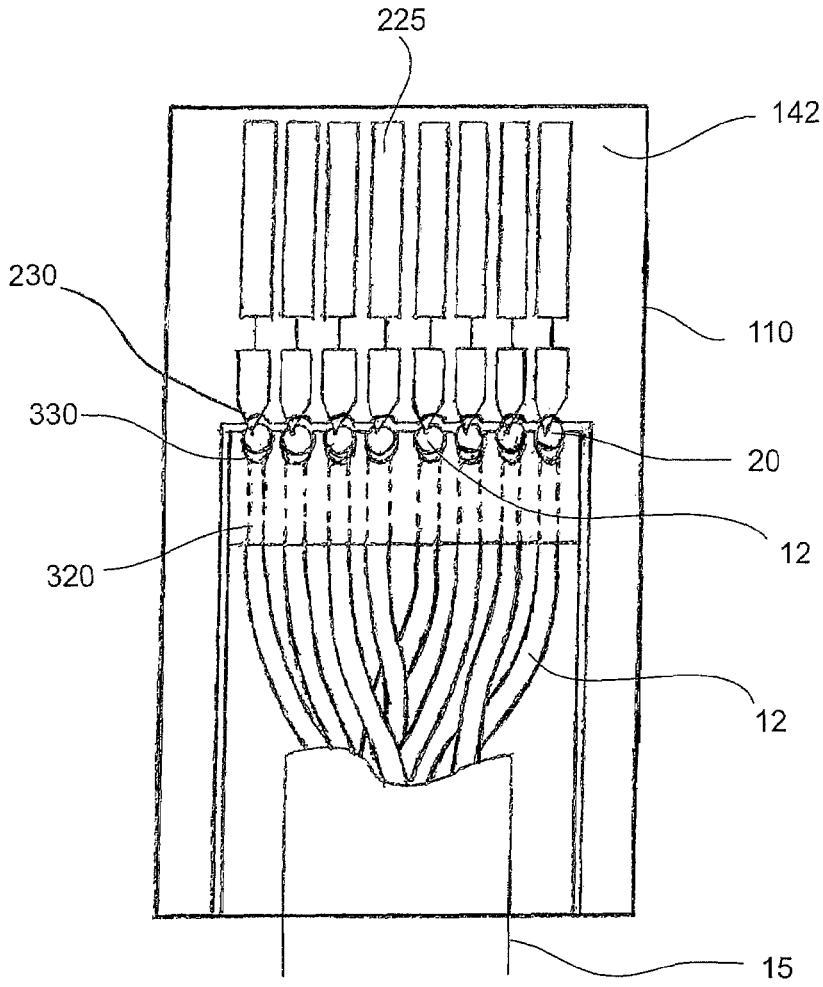
FIG. 4 illustrates a top view of an embodiment of the cable connector in a fully assembled state.

The modular connector insulation displacement contact 200 may work in conjunction with a wire retainer member 300 that may be slidably positionable within a modular connector 100. The wire retainer member 300 may be positioned to contact the stripping blade 230 and the wire contact 235 when inserted into the modular connector 100. As shown in FIG. 3, the wire retainer member 300 may assist in alleviating the requirement for a specialized tool in creating a connector because it may hold and guide an insulated wire 12 against the stripping blade 230 to facilitate exposure of a wire conductor 20, and compress said wire conductor 20 against said contact 235, as shown in FIG. 4. The wire retainer member 300 may guide the insulated wire 12 in the correct position and angle so that the blade 230 can efficiently strip insulation off at least one side and expose the conductive core 20 of the wire 12 so that it may provide a large contact area for wiping contact with the contact 235 of the modular connector insulation displacement contact 200.

The modular connector insulation displacement contact 200 may be installed into a connector housing or body 110 dimensioned to hold at least one of the electrically conductive bodies 210 and the wire retainer member 300 in a position to receive an insulated wire 12. The connector housing 110 is dimensioned to fit into a corresponding socket 99, such as an RJ-45 ethernet type socket 99. The terminal 225 is in positioned within the connector housing 110 for electrical communication with the corresponding socket 99.

Figure 2:
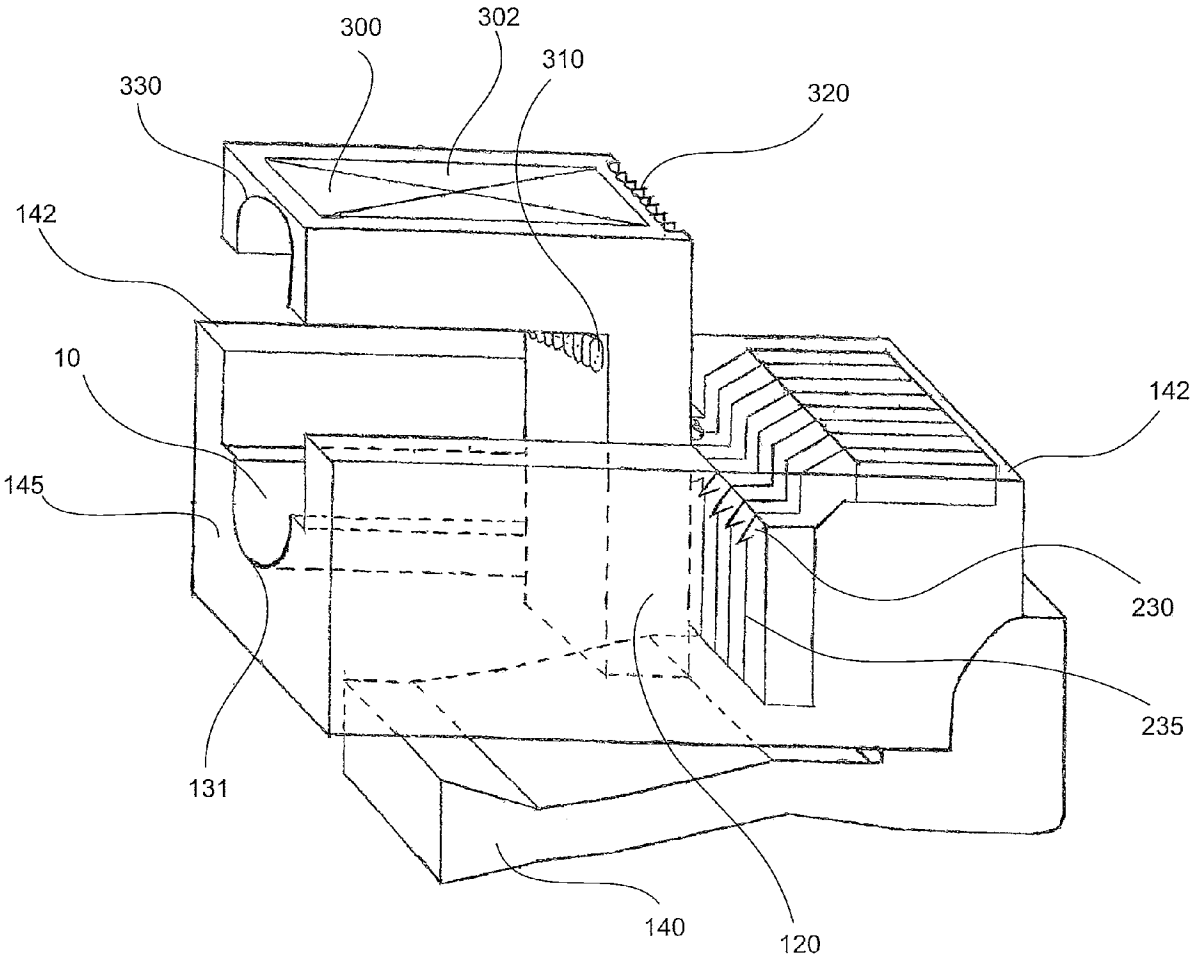
FIG. 2 illustrates a side perspective view of an embodiment of the cable connector in an unassembled state.

The modular connector insulation displacement contact 200 may interact with a compressive insert 300 having at least one hole 310. The hole 310 may be dimensioned to let the insulated wire 12 pass therethrough. In applications where an embodiment of a connector 100 has likeness with an ethernet type RJ-45 connector there may be eight holes 310 that corresponds to the eight terminals 225. The compressive insert 300 may be slidably disposed within a corresponding chamber 120 of the connector housing 110 by a compressive force 302, as shown in FIG. 2. The insulated wire 12, being passed through the at least one hole 310, and may be stripped by contact with the stripper member 230 to facilitate electrical communication between the stripped wire 20 and the contact 235.

The compression of the sliding loader or compressive insert 300 may essentially be accomplished by hand, making the connector assembly 100 basically "tool-less." But compression can also be firmly accomplished with the use of a pair of pliers, or other tools if a user chooses to do so. The use of the sliding loader system 300 may reduce the time needed for proper wire alignment by allowing the user to pass the wires though the holes 310 and review their order outside the connector 100, before compressing the loader 300 down for final connection.

As shown in FIG. 6, the modular connector insulation displacement contact or immobile IDC 200 may be individual one piece terminal connections, running from the wire connection 235 through the connector body, back up to the external connection area or terminal 225. This configuration may allow for a direct connection from the wire 12, through the IDC, to the terminal connectors 225. Moreover, the one piece body 210 may facilitate better connectivity and a lower possible failure rate because only one connection may be needed between the wire 12 and the terminal 225.

The present invention addresses the drawbacks of connectors, including the RJ-45 connector design, installation and reliability problems. Connectors such as an RJ-45 connector without a compressive loader 600 typically require a technician to properly cut and align the twisted wire pairs in a specific order while inserting these wires into extremely small channels inside the connector. However, the instant invention does not require cutting or stripping and it is easy to arrange the wires into the proper order. The old style connectors without a compressive insert 300, 600 have deficiencies that may create bad connections through incorrect wiring and bad termination. A typical old style RJ-45 connector must be tested in the field with a circuit tester to ensure good connectivity because of the high error rate in assembly. The connector 100, 400 design eliminates the drawbacks and simplifies the requirement for installation, without expensive testing and installation equipment to prevent a high error rate.

The connectors 100, 400 addresses the wiring issues found in old style RJ-45 connectors or other connectors by introducing a sliding load system 200 which allows the technician full access to the inside of the connector 100, 400 as well as to the wiring 12. The wire 12 may be loaded individually and the placement of the wire 12 can be reviewed at any time, for proper order and alignment. Once all the wires 12 are placed into the sliding loader 300, 600 and have been reviewed for proper order compression of the loader 300, 600 into the connector body 110, 410 may be provided to make the connection. During the installation of the loader 300 the wires 12 in the loader have their insulation 20 sheared off as they pass the IDC blades 230. Moreover, during compression a conductive portion 20 of the wires 12 then lay flat against the IDC contact 235, creating a solid and consistent termination. The installation of the loader 600 may intersect the blades 530 and create a termination with a known order and termination without crosstalk and a consistent termination. In addition, full engagement of the loader 300, 600 into the connector body 110, 410 does not require the technician to purchase a crimping hand tool like may be required to be used in an old style RJ-45 connectors.

Another embodiment may be modular connector 100, 400 that does not require special tools for assembly. The modular connector 100, 400 may comprise a connector body 110, 410. There may be at least one terminal member 200, 500 disposed in the connector body 110, 410, wherein the terminal ember 200, 500 has a blade 230, 530, and a contact face 235, 535. The modular connector may have a non-conductive connector body 110, 410 that may be made out of a dimensionally stable grade of plastic that is injection molded. The connector body could be either a multi-part body that is assembled from multiple pieces with the terminal member 200, 500 installed during assembly or the terminal member 200, 500 can be an injection molded insert, wherein the body 110, 410 is formed around the terminal member 200, 500.

Figure 9:
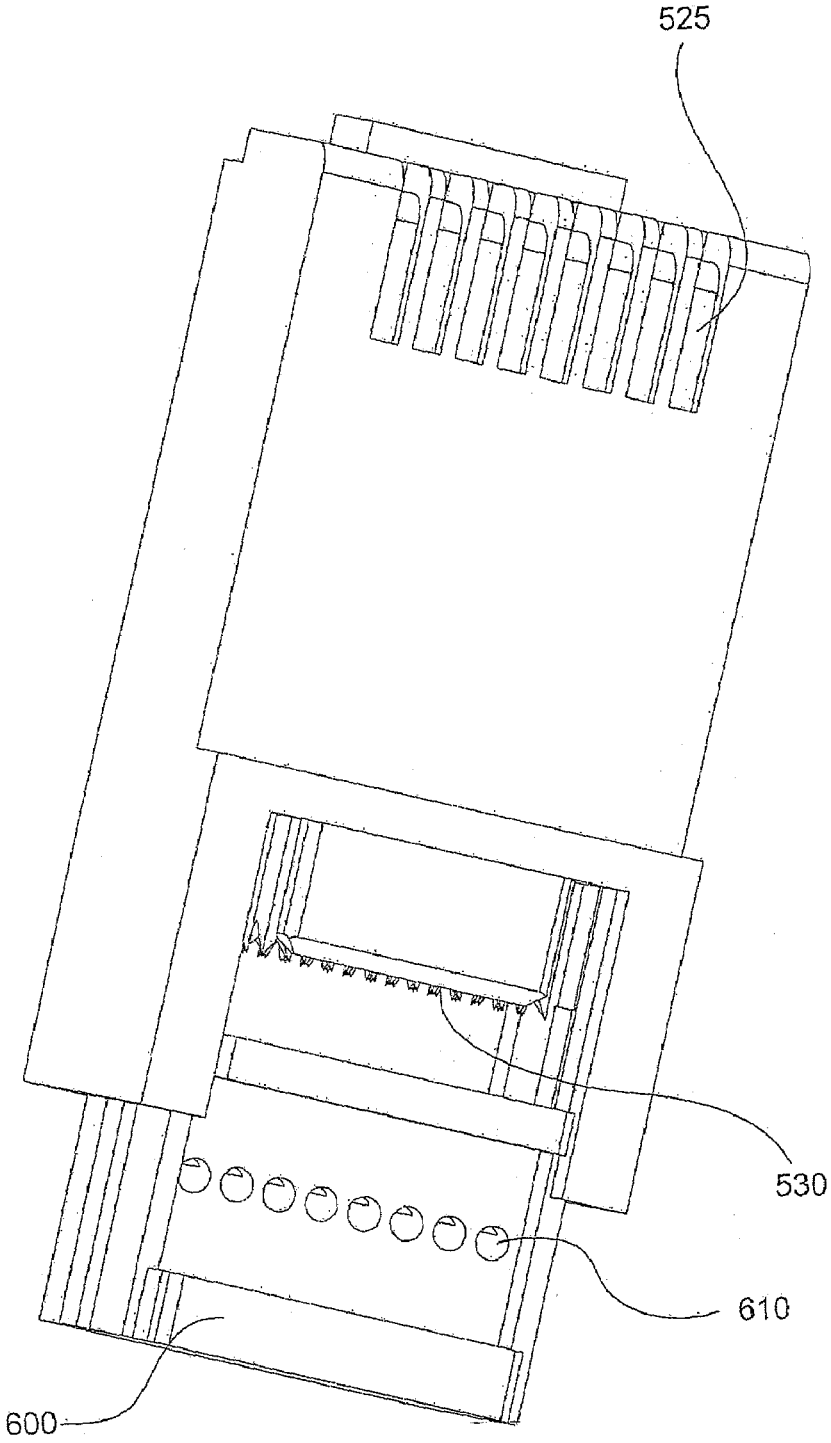
FIG. 9 shows a perspective view of an embodiment of a connector in a partially assembled state.
Figure 10:
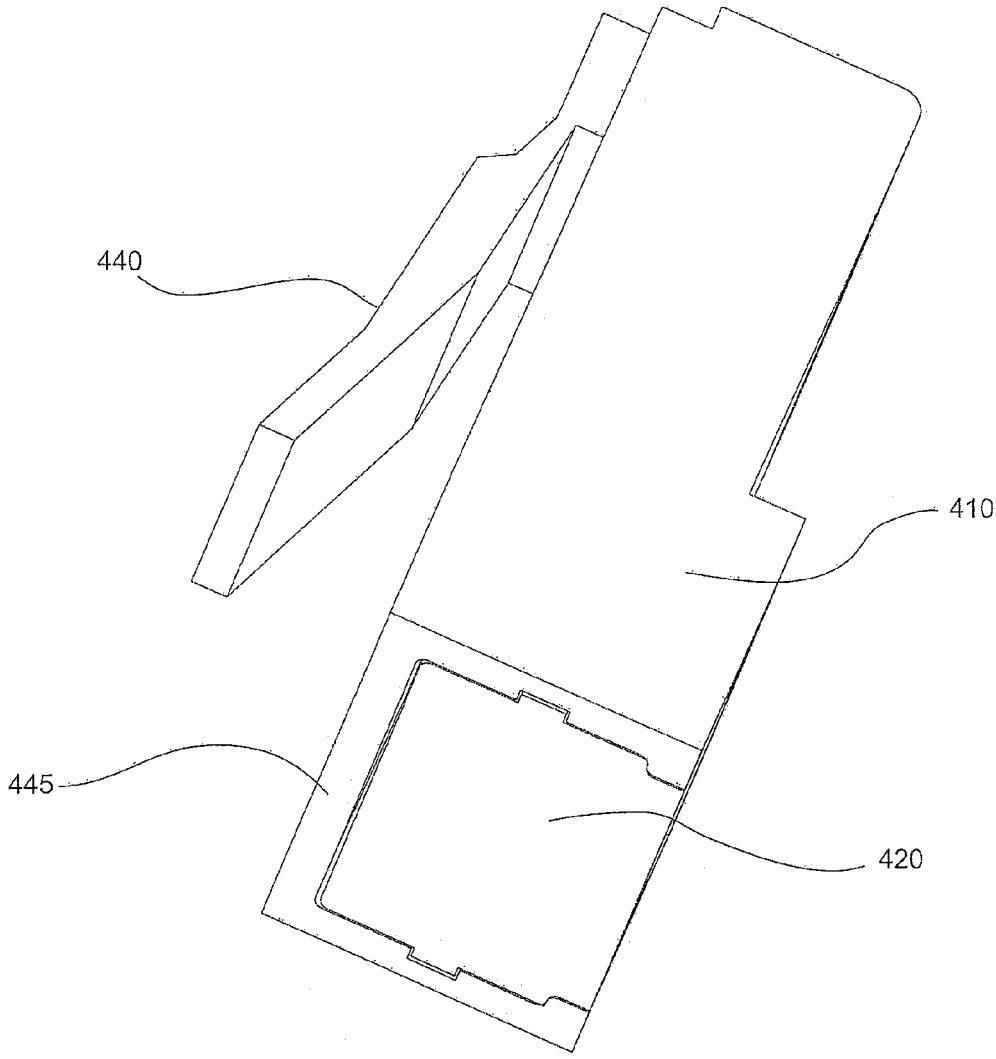
FIG. 10 shows a bottom perspective view of an embodiment of a connector in a disassembled state.

To provide easy alignment of the wires 12 in the connector body 110, 410 a wire loader 300, 600 configured for sliding engagement within the connector body 110, 410 is provided. The wire loader 300, 600 may have at least one hole 310, 610 corresponding to each terminal member 200, 500. The hole 310, 610 may be dimensioned therein to let an insulated wire 12 be inserted therethrough, before the wire loader 300, 600 is slidably disposed within the connector body 110, 410. As shown in FIGS. 4 and 9, the inserted wire 12 may be positioned to be in contact with said blade 230, 530 so the blade 230, 530 may be pressed into electrical communication with the at least one terminal member 200, 500.

A wire loader 300, 600 configured for sliding engagement within the connector body 110, 410 may include at least one locking tab 350, 650 positioned on the wire loader 300, 600 to lock the wire loader 300, 600 into the connector body 110, 410. The locking tab 350, 650 may prevent loss of tension of the wire 12 against the contact 235, 535 and also may act as a strain relief by helping to distribute pressure. The locking tab 650 may be an angled protrusion 655 that allows attachment with hooks or edge 657 that prevents backing out.

A modular connector 100, 400 may have a wire retaining groove 320, 620 positioned adjacent the holes 310, 610 in the compressive insert 300, 600. The groove 320, 620 may be positioned to hold the inserted wire 12 for contact with the blade 230, 530. The retaining groove 320, 620 may help to aid in producing a lesser number of defective connectors by aiding in the visual identification of the order of the wires with respect to the terminals. A large number of errors come from installers being forced to use very short wire segments to minimize crosstalk from unwound twisted pairs of wires 12 found in data cables 15. However, a modular connector 100, 400 may include a compressive insert 300, 600 in conjunction with the novel terminal member 200, 500, which may contact and transmit a signal very near the end of the untwisted wire despite the exposed length in the retaining groove 320, 620.

A modular connector 100 may also include a strain relief cable cradle 130, wherein said cradle 130 may be a depression dimensioned to receive a cable 15, a first portion 131 of said cradle 130 is within the connector body 110 and a remaining portion 330 is within the wire loader 300. The strain relief cable cradle 130 may be formed when the wire loader 300 is fully inserted into the connector body 110. The compression of the cable 15 by the strain relief cable cradle 130 may prevent pullout or breaking of the wires 12 within the connector 100.

A terminal lock 240, 540 may be present to prevent movement of the terminal 210, 510 within the connector body 110, 410. The terminal lock 240, 540 may be configured to retain said terminal member 210, 510 when said terminal member 210, 510 is properly positioned in said connector body 110, 410. Furthermore, the terminal lock 240, 540 may have a second lock 241, 541 that may help to provide even further stability. The locks 240, 241, 540, 541 are the edges of the surface on the terminal 210, 510 that butts against a corresponding section of the connector body 110, 410 configured to accept the terminal lock 240, 540 and prevents movement of the terminal body 210, 510.

The connector 410 may have a loader system 600 that contacts the blade 430 with an alternative system using a different terminal member 210. The terminal member 210 may have a base 550, wherein a blade 430 may be on a base 550 and a wire contact 535 may be disposed between the blade 530, and the base 550. The blade 430 may be or comprise the edges of what may be any polygonal object such as a triangle and the contacts 535 may be or comprise the faces of corresponding polygonal objects. The loader 600 may have at least one groove 620 to retain the insulated wire 12, wherein the groove 620 may position the wire 12 in the loader 600 to compress the insulated wire 12 against the blade 430 and compress the insulated wire 12 into and against the contact 535. The wire 12 may have the insulation pierced by the blades 430 exposing a small section of conductive core 20, which is then pressed against the contacts 535.

A modular connector 100, 400 may comprise a connector body 110, 410 having a connector locking tab 140, which could be integral or mounted to the body 110, 410. The locking tab 140 may prevent unintended release of the connector from a socket 99. As shown in FIGS. 1-3, a first side 141 of said connector body 110 may include the connector locking tab 140. A chamber 120 may be present in a side 142, or an end 145 of said connector body 110, said chamber 120 dimensioned to accept said loader 300. When the loader 300 is positioned on the second side 142 of the body 110 it may be more readily configured for use of the terminal 200 or terminal bank 250 as shown in FIGS. 5 and 6. As discussed the side 142 of said connector body 110 may have the chamber 120 positioned in said second side 142, wherein said loader 300 is configured to slidably position said wire 12 against said blade 230 to strip insulation 20, as shown in FIGS. 3 and 4.

Figure 11:
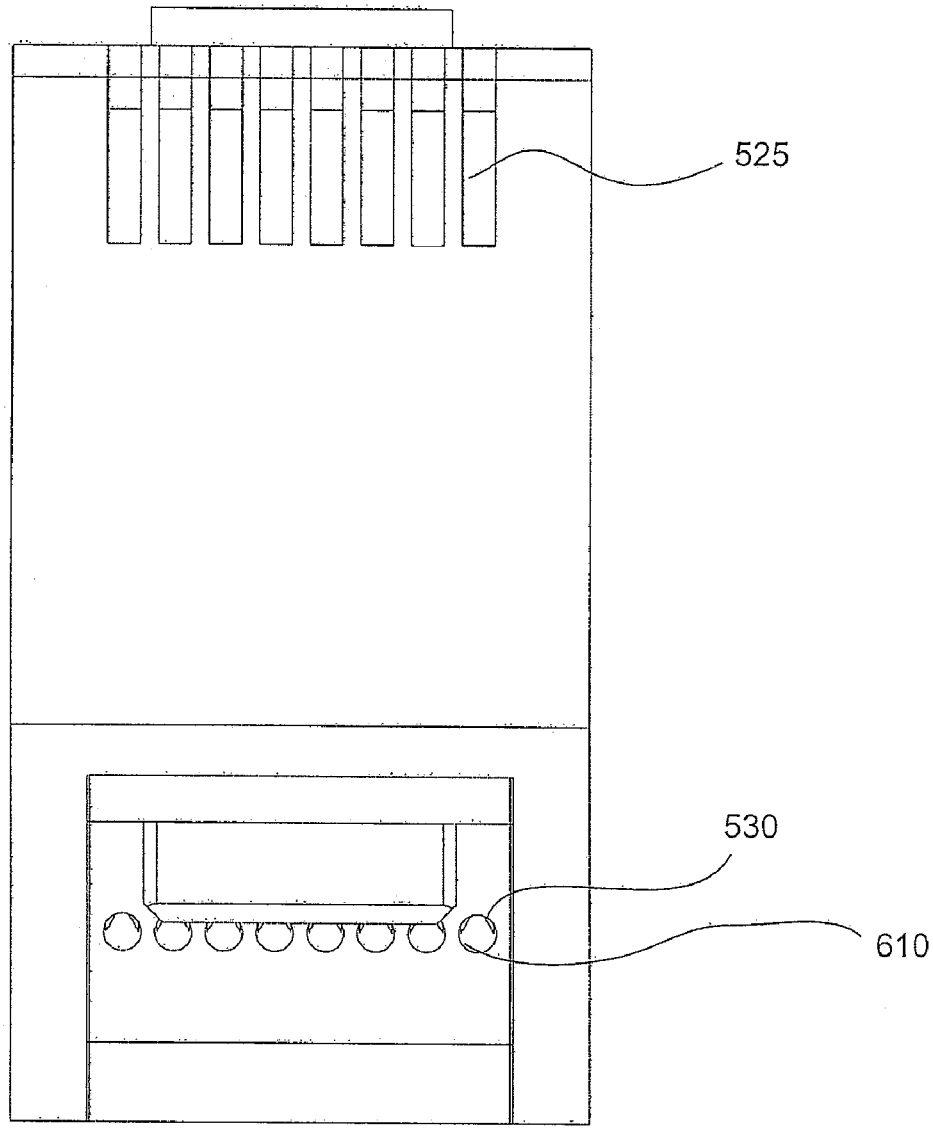
FIG. 11 shows a perspective view of an embodiment of a connector in an assembled state without a wire or cable present.
Figure 12:
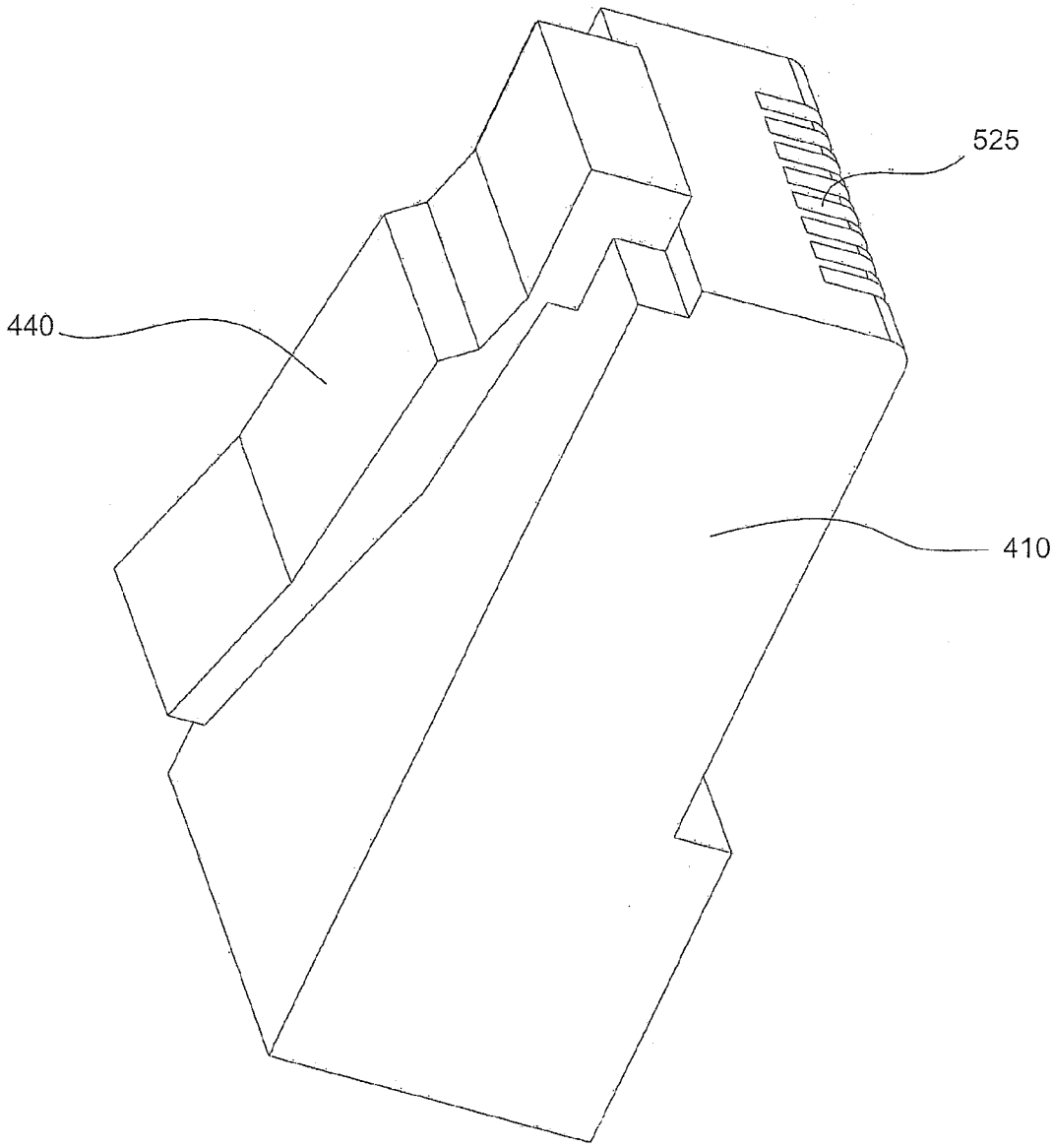
FIG. 12 shows a side perspective view of an embodiment of a connector in an assembled state.
Figure 13:
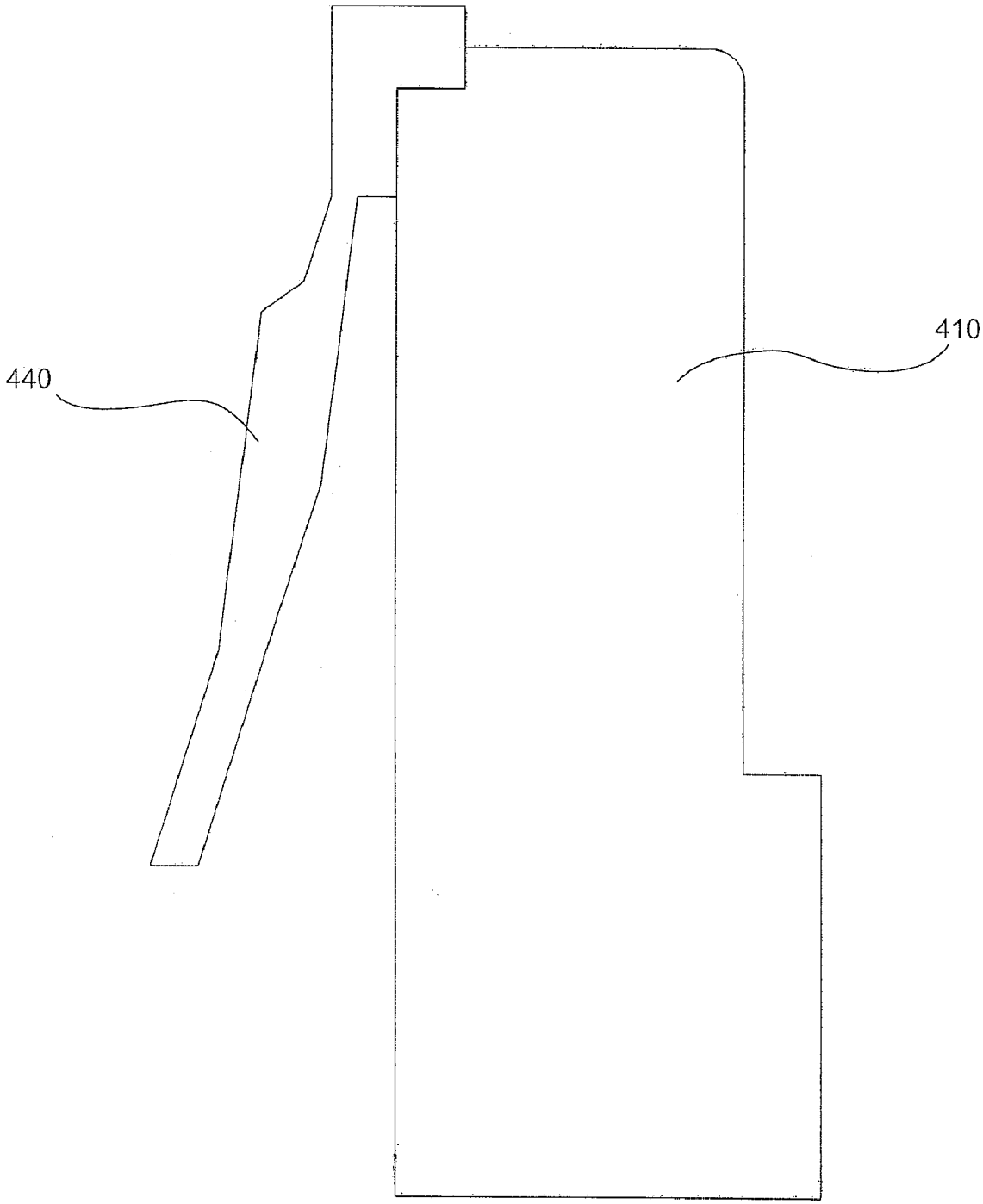
FIG. 13 shows a side view of an embodiment of a connector in an assembled state.
Figure 14:
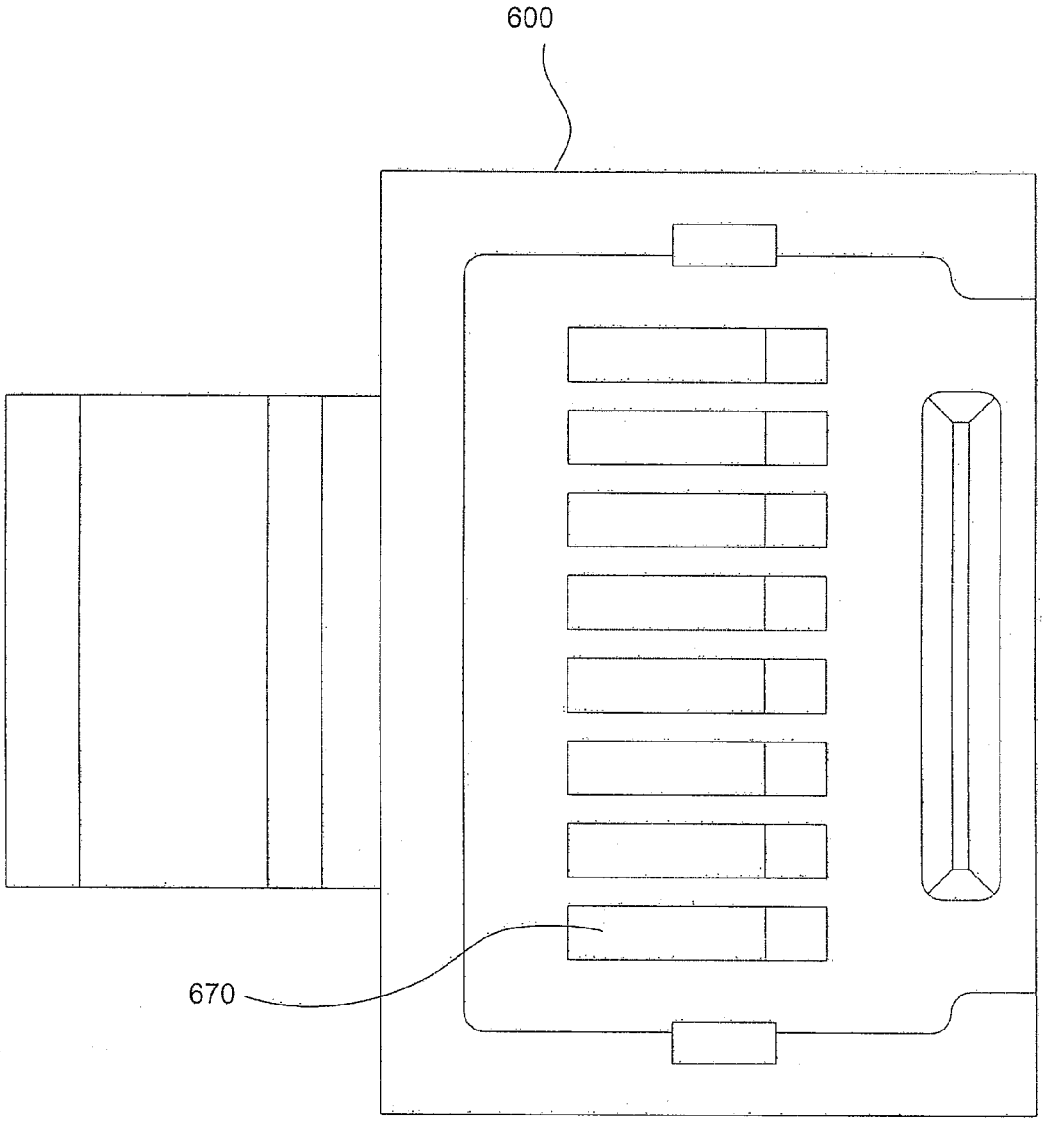
FIG. 14 shows a bottom view of an embodiment of an insert for a connector.
Figure 15:
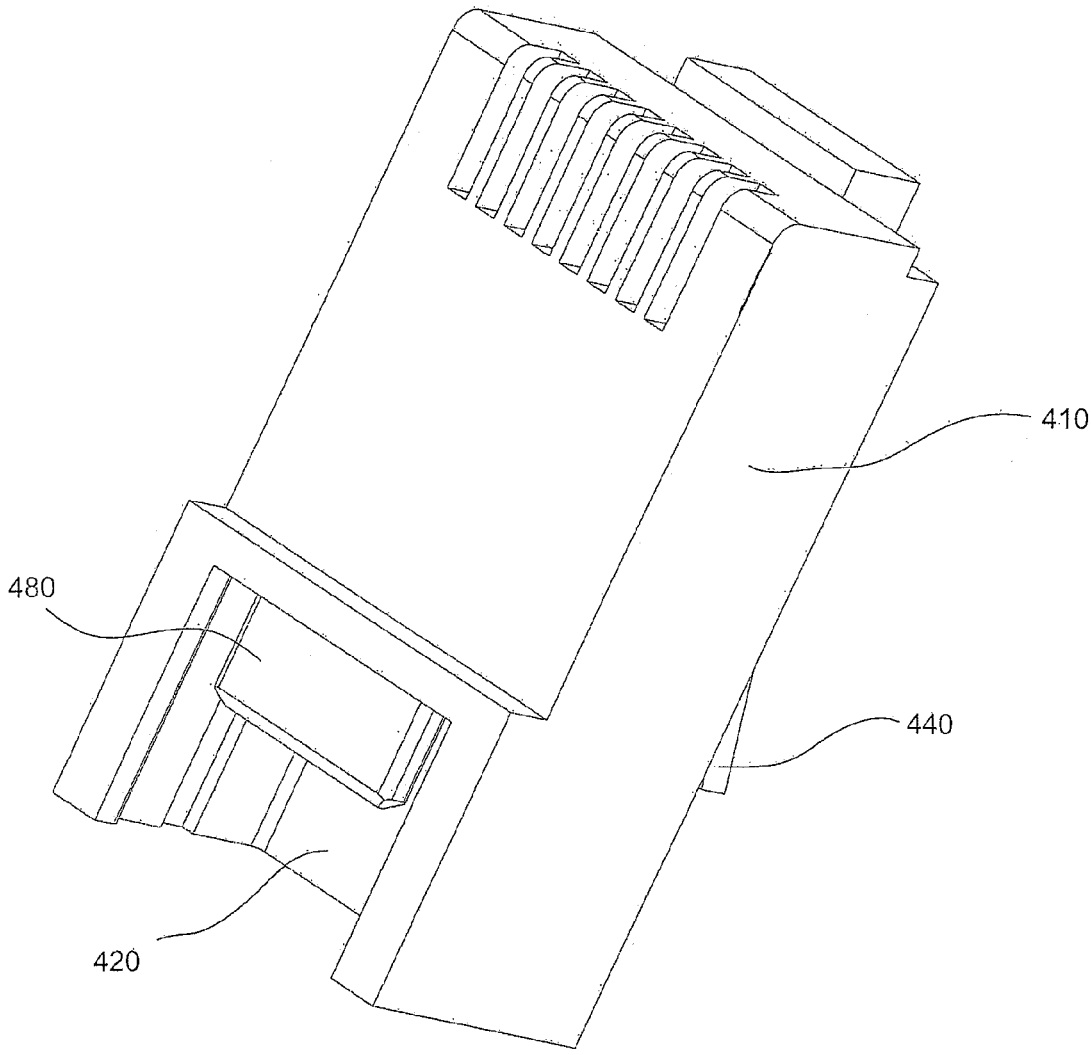
FIG. 15 shows a perspective view of an embodiment of a connector in a partially assembled state.
Figure 16:
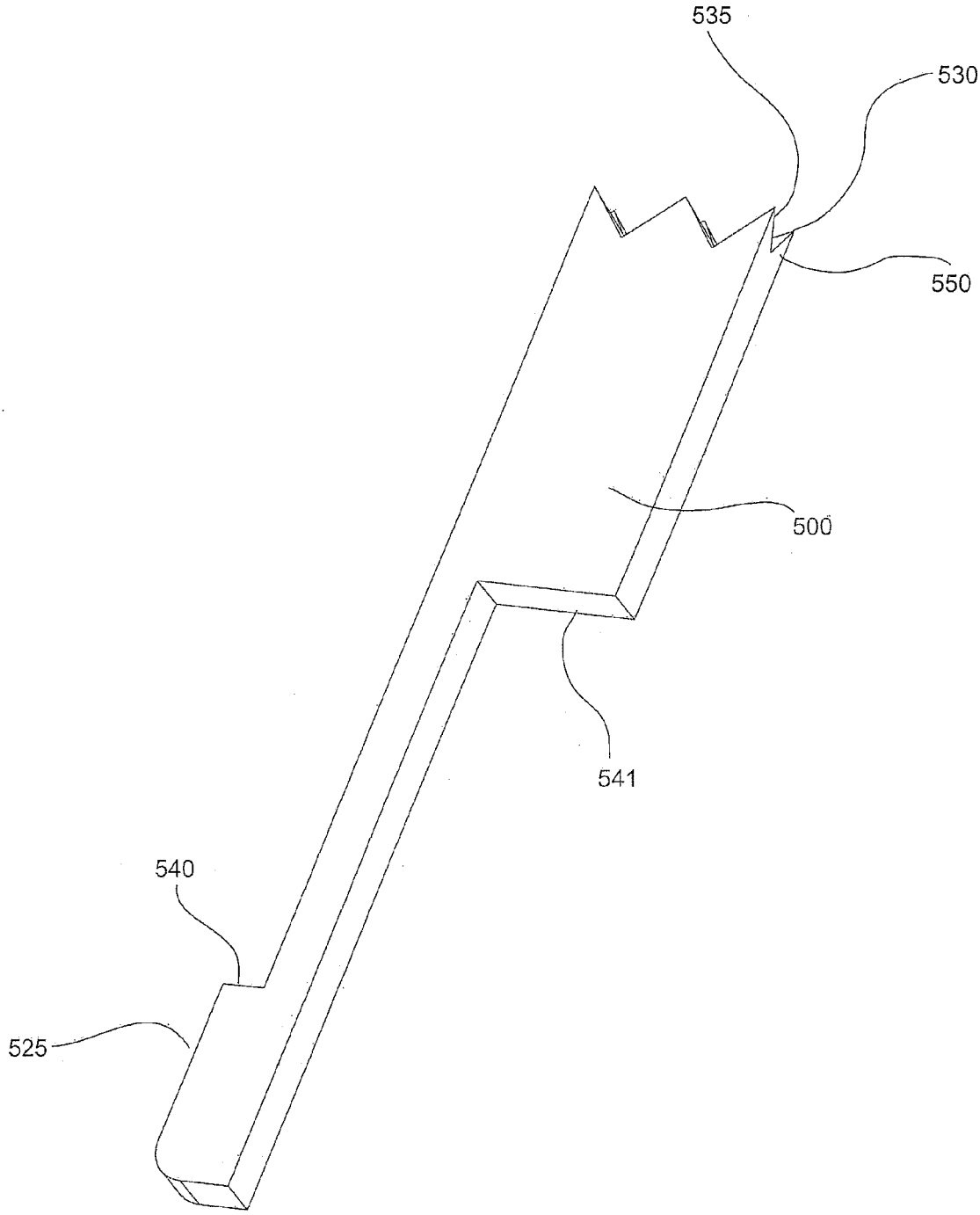
FIG. 16 shows a side view of an embodiment of an electrically conductive body.
Figure 17:
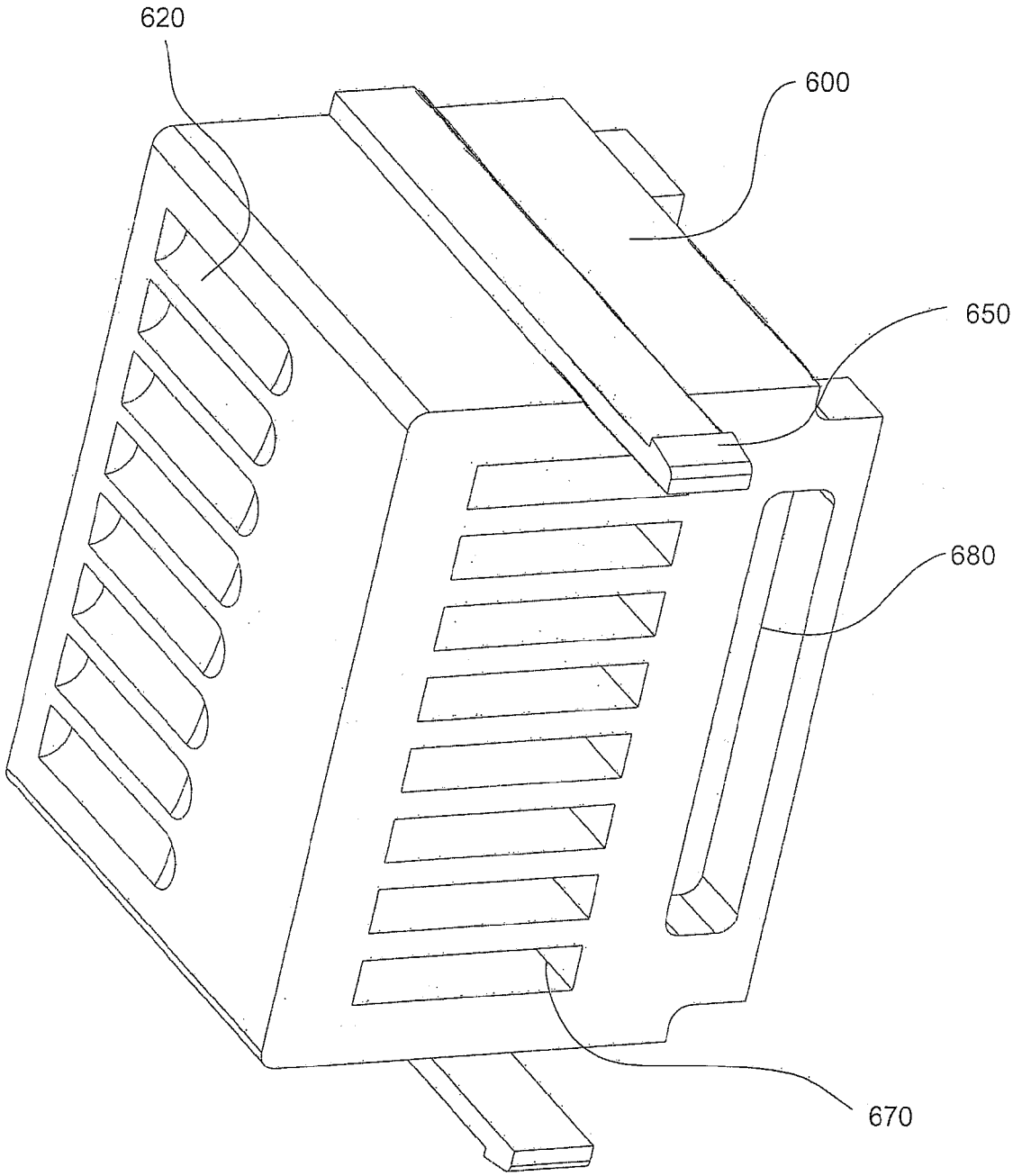
FIG. 17 shows a side perspective view of an embodiment of an insert for a connector.
Figure 18:
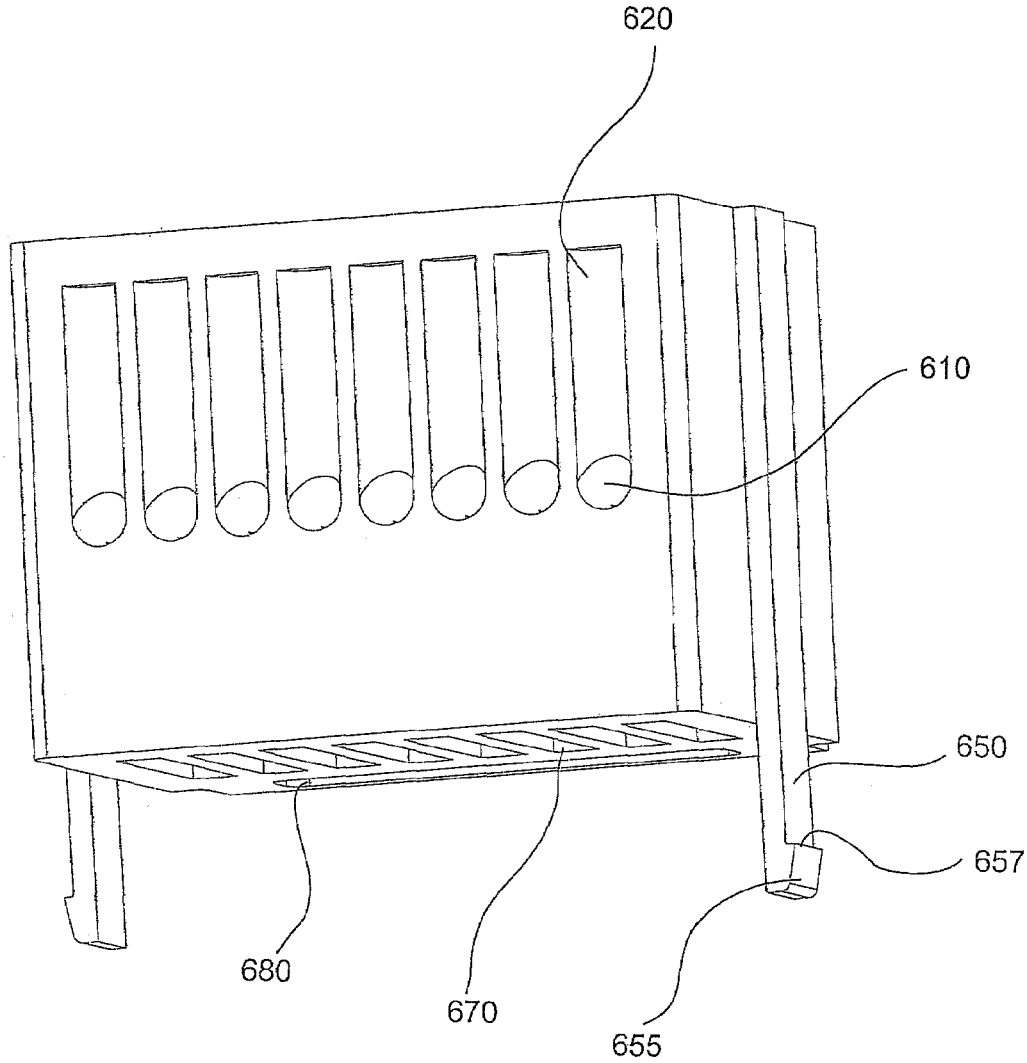
FIG. 18 shows another side perspective view of an embodiment of an insert for a connector.
Figure 19:
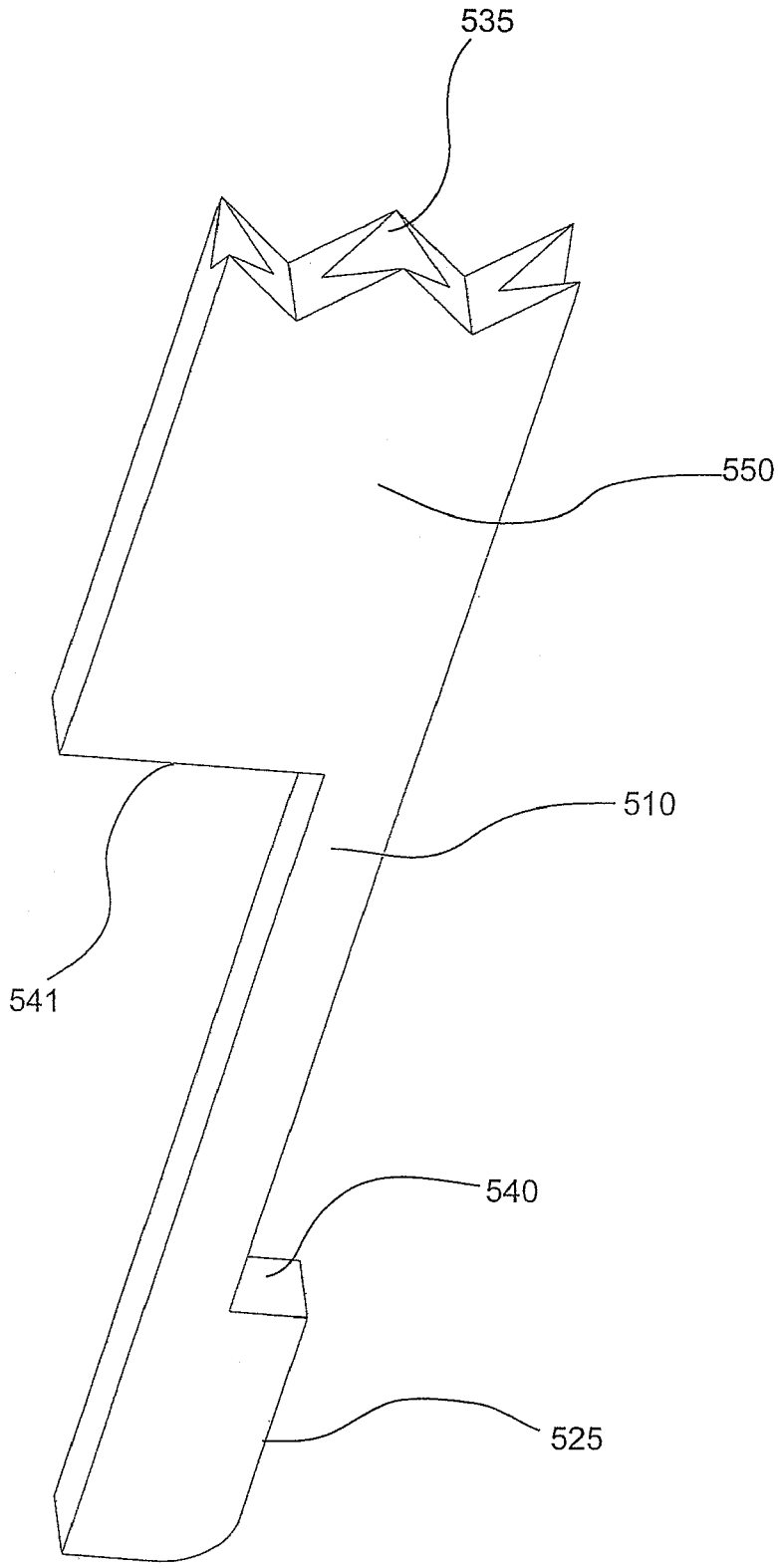
FIG. 19 shows a side perspective view of an embodiment of a conductive member for a connector.
Figure 20:
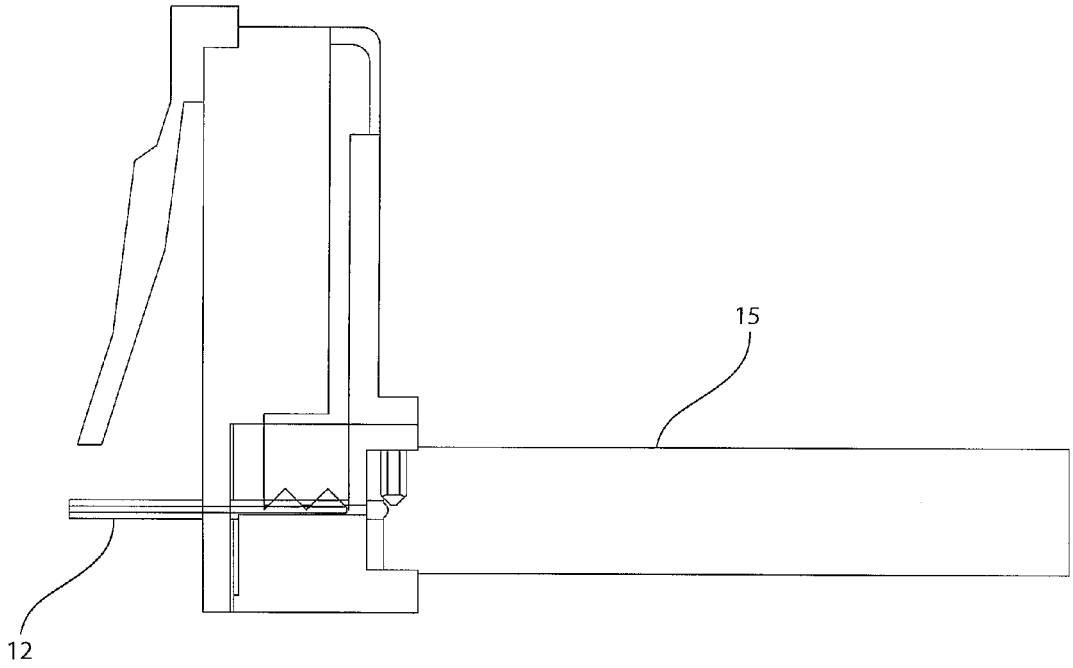
FIG. 20 shows a cutaway view of an embodiment of a connector in a partially assembled state with a cable and at least one wire inserted.
Figure 21:
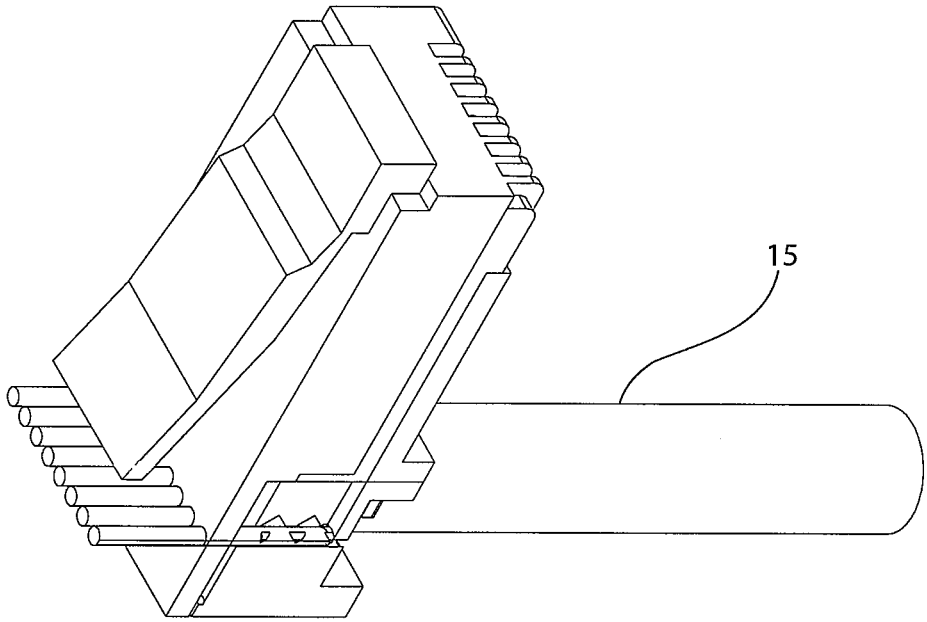
FIG. 21 shows a perspective cutaway view of an embodiment of a connector in a partially assembled state with a cable and at least one wire inserted.
Figure 22:
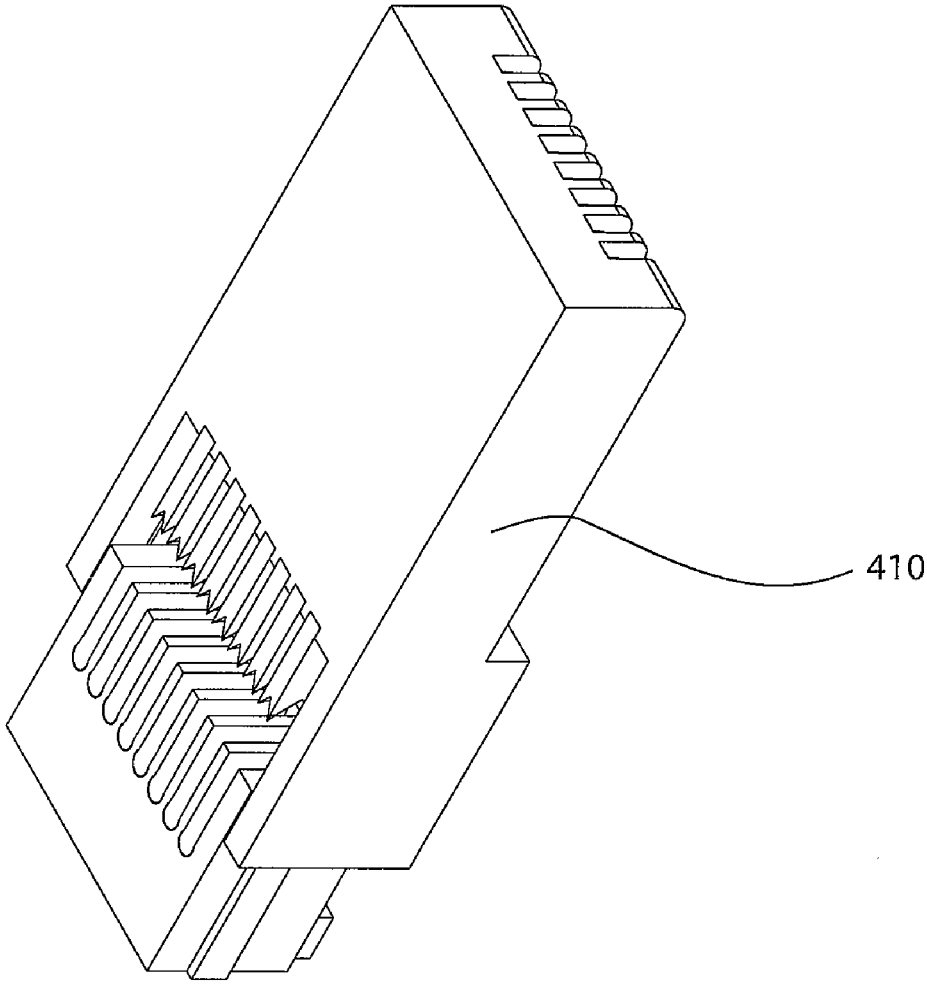
FIG. 22 shows a cutaway view of an embodiment of a connector in a partially assembled state.
Figure 23:
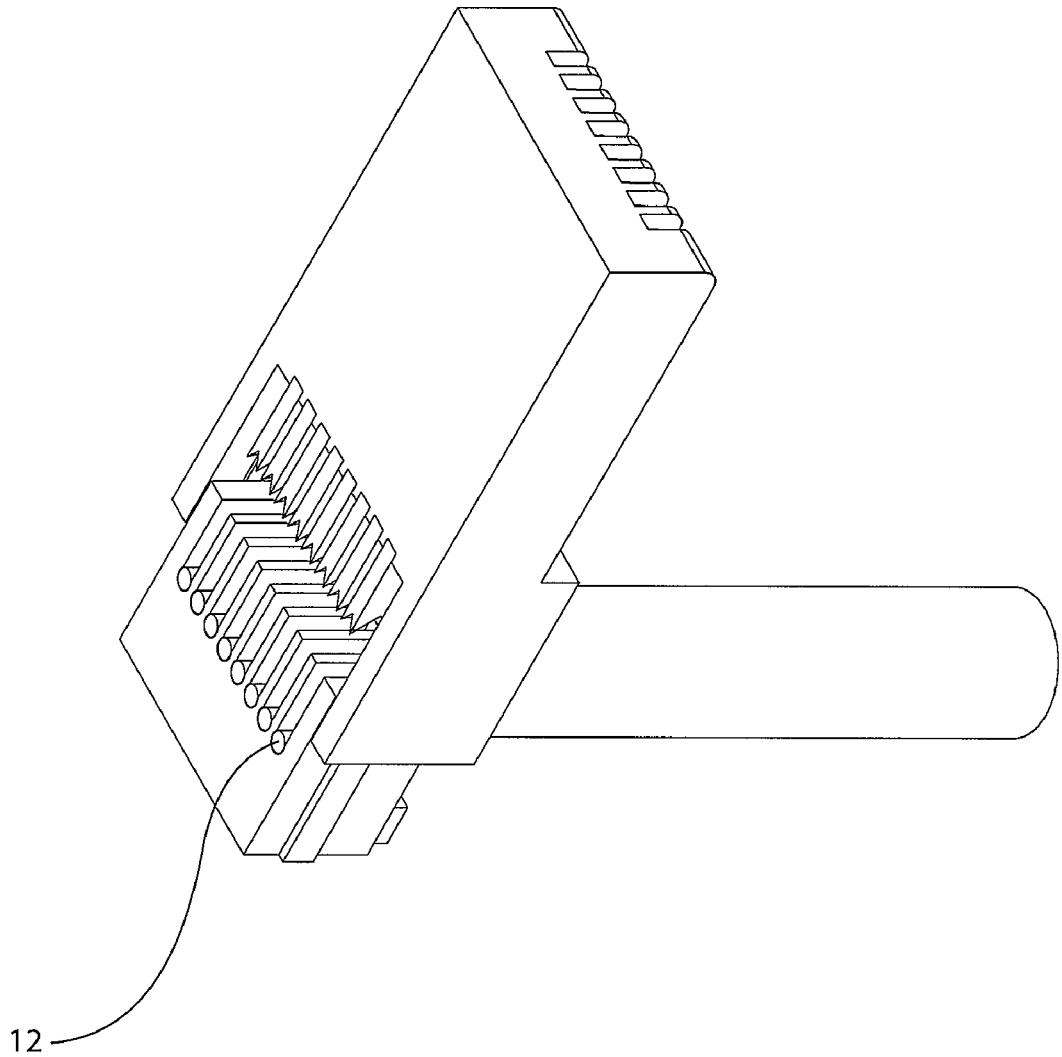
FIG. 23 shows a cutaway view of a an embodiment of connector in a partially assembled state with a cable and at least one wire inserted after trimming.

Alternatively, an end 145, 445 of said connector body 110, 410 may have a chamber 120, 420. The chamber 120, 420 may be positioned in said end 145, 445, wherein said loader 600 may be configured to facilitate the compression of said wire 12 against said blade 530 to make said electrical contact. The loader 600 may include blade entry guides 670 that may accept a terminal shaft 550 with the blades 530 at the end of the body 510. The blades 530 may contain contacts 535 in the valleys between the blades 530 and in addition the blade 530 itself may act as a contact 530. The blade 530 being part of the body 510, which is electrically conductive has the ability to conduct signals if in contact with the stripped wire 20. The hole 610 in the loader 600 may intersect the entry guides 670 as shown in FIG. 11 to ensure good connectivity.

Additionally, the connectors 100, 400 may contain features absent from current Ethernet connector technology. The IDC design 200 and the manner of use of the IDC's 200 within a connector 100 containing wire insulation shearing blades 230 may provide more surface area for a physical and electrical connection. The increased surface area for the connection may aid in addressing high frequency concerns related to RF interference and crosstalk between the twisted pairs. Another feature of the connectors 100 may be the ability for the IDC 200 to fully prepare the wire 12 as it passes into the IDC area 235, by shearing the insulation 20 and then forcing the wires 20 tightly against the flat IDC bodies 235 with the compression of the sliding loader 300.

In one embodiment, the IDC 200, 250 may be one continuous piece, with the face 220 bearing the shearing blade 230 and flat contact area 235 and then connecting back up to the terminal contact area 225 on the connector 100. This one piece IDC may function similar to standard IDCs in current RJ-45s, but would not require crimping to engage the wire. Avoiding the crimping step decreases faulty crimps, wherein some of the individual IDCs of common connectors can be over or under crimped, causing bad terminal contacts.

Referring to FIG. 1, an embodiment of a cable connector 100 is shown in an unassembled state. Connector 100 may have a sliding loader section 300 with through-holes 310 where the twisted wire pairs 12 can be separated and loaded into for connection. An arcuate depression 16 may be found on both the connector body 110 and sliding loader 300 to accommodate a cable 15 once it is inserted. An RJ-45 type connector typically has eight terminals 225 and locking tab 140 located in their positions on the external connector body 110 configured to be received by an RJ-45 jack. The surface area for compression 302 of the sliding loader 300 is also illustrated to show where an installer may compress the wires 12 into the IDC cutting blades 230 internally.

As shown in FIG. 2, an embodiment of a cable connector 100 is shown in an unassembled state and depicts how the sliding loader 300 may be compressed into the connector body 110. Additionally, as shown in FIG. 3, grooves 320 may help with providing proper wire alignment. The grooves 320 on the sliding loader body 300 may act as wire guides 320 as the loader 300 is compressed into the connector body 110. As the grooves 320 hold the wires 12 in place, the wire insulation shearing blades 230 may then strip the wires 12 as they pass into the connector 110, thus making a positive and substantial connection.

FIG. 3 shows a side view of the cable connector 100 in a partially assembled state wherein the cable 15 has its twisted pairs of wires 12 inserted into the through-holes 310, up and into the grooves 320 for proper wire alignment prior to securing the wires 12 in the connector body 110. Once all the twisted pairs of wires 12 are secured into the sliding loader 300, the loader 300 can be compressed and the wire insulation shearing blades 230 can create the needed connection with the internal IDCs contact 235.

FIG. 4 displays a top view of the cable connector 100 assembled state with the cable 15 and secured wires 12 are locked into place within the connector body 110. The wire insulation has been sheared of the insulation on one side by the blades 230 that have prepared the wires 12 to be compressed into position against the IDCs 200, 250. The compression of the stripped wires 20 forms a positive connection on each individual contact 235.

FIG. 5 displays a perspective view of the Insulation Displacement Contacts (IDC s) 200 and their wire insulation shearing blades 230. As the wire 12 passes the shearing blades 230, the wire insulation is displaced and then the wire having an exposed copper core 20 lays and/or is located securely against the IDCs body 210 in the contact section 235, as illustrated in FIG. 5.

FIG. 6 displays a perspective view of the IDC 200, as one complete linking piece between the wire 12 termination and terminal connection 225, as another separate embodiment. Instead of using a separate connection system within the connector 100 from the IDC 200 to the terminal connection 225, these IDCs are one continuous connection throughout because they are a single piece unit having all features required. This one piece system or body 210, 610 prevents failures due to poor connections between the wire contact and the conductor such as mechanical/electrical fasteners or welds that my break or come loose.

Embodiments of a modular connector 100, 400 may comprise a connector body 110, 410 that may be made out of an insulative material such as a plastic. The connector body 110, 410 may be assembled from many parts or injection molded in a single step with the terminals 200, 500 molded directly into the connector body 110, 410. The body 110, 410 may be dimensioned to work as an RJ-45 internet connector.

The connector body 110, 410 may have a chamber 120, 420 dimensioned to accept a compressive insert 300, 600. The compressive insert 300, 600 may be slidably disposed within the connector body 110, 410. Additionally, there may be at least one hole 310, 610 within the compressive insert 300, 600 that may be dimensioned to receive an insulated wire 12. To guide and retain the wire 12 within the body 110, 410 there is at least one alignment groove 320, 620 adjacent to the at least one hole 310, 610. There are typically eight alignment grooves 320, 620 and holes 310, 610 in an RJ-45 type ethernet connector. A groove 320, 620 may be dimensioned to receive the insulated wire 12.

The connector 100, 400 may have at least one contact member 200, 500, said contact member 200, 500 having at least one blade 230, 530 and at least one terminal 225, 525, said contact member 200, 500 is positioned within the main connector body 110, 410 adjacent said compressive insert 300, 600, wherein said compressive insert 300, 600 compresses the insulated wire 12 against the contact 235. Optionally, the compressive insert 300 and the contact member 200 may be oriented so that the at least one blade 230 can shear off at least a portion of an insulation jacket 20 from the wire 12 when the compressive insert 300 is engaged.

A modular connector 100, 400 may also comprise a locking connector tab 140, 440 affixed to the connector body 110, 410. The modular connector 100, 400 has an output end 142 of the connector 100, 400 wherein at least eight contact members 225 are arranged, wherein said connector body 110, 410 may be dimensioned to be received by an RJ-45 style jack.

Another embodiment may comprise a modular ethernet connector 100, 400 including a connector body 110, 410. The body 110, 410 may be configured to be accepted by an RJ-45 type jack, which is commonly used as the industry standard ethernet cable. The connector body 110, 410 may have an insert 300,600 slidably disposable within the connector body 110,410. The insert 300, 600 may allow for the creation of a connector 100, 400 without the use of tools.

The insert 300, 600 may have at least eight holes 310, 610 as is the standard with an RJ-45 type connector. Within the insert 300, 600 the holes 310, 610 may be dimensioned to receive a wire having a jacket 12. In addition, there may be at least eight alignment grooves 320, 620 adjacent to each of the at least eight holes 310, 610. The grooves 320, 620 may be dimensioned to receive the wire 12 having the jacket. The wires 12 may untwisted from the cable 15 to almost any desired length for easy viewing and order arrangement without regard to common problems associated with crosstalk and interference. Still further the wires 12 may be placed into the appropriate holes 310, 610 and grooves 320, 620 and examined without fearing of losing the correct order of wires 12.

Within the connector body 110, 410 may be a contact terminal 220, 520 positioned to be in contact with at least one means for electrically connecting the contact terminal 220, 520 to the wire 12 having the jacket. The means of connecting the contact terminal 220, 520 may include a one piece contact having a blade 230, 630 positioned on the terminal body 210, 510 so as to contact and remove or pierce a portion of insulation of a wire 12 exposing a conductive core 20. The conductive core 20 may then be compressed against a contact 235, 535 that is a portion of the body 210, 510 by the insert 300, 600.

A method of forming a cable 99 from a wire 12 and a modular connector 100, 400 may comprise providing a cable 15 having at least one insulated wire 12. Additionally the method may include providing a connector body 110, 410 having a chamber 120, 420. Then providing a wire loader 300, 600 having at least one hole 310, 610, said hole 310, 610 dimensioned therein to let the at least one insulated wire 12 pass therethrough. Moreover, the method may include, providing at least one groove 320, 620 adjacent the at least one hole 310, 610, said groove 320, 620 positioning the least one insulated wire 12.

To make a connector start by inserting the at least one insulated wires 12 through the at least one hole 310, 610 and into the at least one groove 320, 620. If the arrangement of wires in the connector 100, 400 is satisfactory, then the loader 300, 600 may be compressed into the connector 100, 400 to make an electrical connection with the at least one insulated wire 12.

Further methodology for forming a connector may include providing a portion of a strain relief section 130 in the connector body 130 and the loader 330. In addition, the cable 15 may be secured when the loader 300 is compressed. If extra wire extends beyond the connector then the methodology may include trimming at least one end of the at least one of the plurality of insulated wires 12 extending from the connector 100, 400.

Various modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

I claim:

1. A modular connector insulation displacement contact comprising:

at least one electrically conductive body configured to be mounted within a modular connector, said body having a first surface and a second surface, said body further including:

a connector terminal positioned on the first surface of the body, wherein said terminal is configured to transmit an electrical signal;

a stripping blade angularly protruding from between the first surface and the second surface of the body, said stripping blade configured to strip insulation of a wire compressively slid upon said blade and electrically expose a conductive element of the wire; and a wire contact positioned at the second surface of the body adjacent the stripping blade, wherein said wire contact is configured to receive electrical signals from said exposed conductive element of said wire when said exposed conductive element of said wire is compressed against said wire contact.

2. The modular connector insulation displacement contact of claim 1 further comprising:

a contact bank including at least two or more of said electrically conductive bodies, said electrically conductive bodies being arranged linearly in parallel with each other so that each terminal is adjacent to another terminal, each wire contact is adjacent to another wire contact and each blade is adjacent to another blade.

3. The modular connector insulation displacement contact of claim 1 further comprising:

a first geometric plane that corresponds to the terminal of the at least one electrically conductive body;

a second geometric plane that corresponds to the wire contact; and an intersection of the first geometric plane and the second geometric plane that corresponds to a position of the stripping blade, wherein the intersection may form an angle of 10-170 degrees.

4. The modular connector insulation displacement contact of claim 1 further comprising:

a wire retainer member slidably positionable within the modular connector, said member positioned to contact the stripping blade and the wire contact when inserted into the modular connector, wherein the wire retainer member holds and guides an insulated wire against the stripping blade to facilitate exposure of a wire conductor, and compress said wire conductor against said wire contact.

5. The modular connector insulation displacement contact of claim 4 further comprising:

a connector housing dimensioned to hold said at least one electrically conductive body and the wire retainer member in a position to receive the insulated wire, wherein said connector housing is dimensioned to fit into a corresponding socket, and the connector terminal is in position for electrical communication with the corresponding socket.

6. The modular connector insulation displacement contact of claim 1 further comprising:

a compressive insert having at least one hole, said at least one hole dimensioned to let the insulated wire pass therethrough, wherein when said insert is slidably disposed within a corresponding chamber of the connector housing by a compressive force, further wherein the insulated wire, being passed through the at least one hole, is stripped of insulation by contact with the stripping blade to facilitate electrical communication between the stripped wire and the wire contact.

7. A modular connector comprising:

a connector body;

at least one terminal member disposed in said connector body, wherein said at least one terminal member has a blade, and a contact face adjacent the blade; and a wire loader configured for sliding engagement within the connector body, said wire loader having at least one hole corresponding to said terminal member, said hole dimensioned therein to let an insulated wire be inserted therethrough, wherein when said wire loader is slidably disposed within the connector body, the inserted insulated wire is positioned to be pressed between the blade and the wire loader to facilitate exposure of a conductive portion of the insulated wire, and press said conductive portion into electrical communication with the contact face of the at least one terminal member.

8. A modular connector of claim 7 further comprising:

a wire retaining groove positioned adjacent the at least one hole in the wire loader, said groove is positioned to hold the inserted insulated wire for contact with said blade.

9. A modular connector of claim 7 further comprising:

a strain relief cable cradle, wherein said cradle is a depression dimensioned to receive a cable, a first portion of said cradle is within the connector body and a remaining portion is within the wire loader, said strain relief cable cradle formed when the wire loader is fully inserted into the connector body.

10. A modular connector of claim 7 further comprising:

at least one locking tab positioned on said wire loader to lock said wire loader into the connector body.

11. A modular connector of claim 7 further comprising:

a terminal lock, said lock configured to retain said terminal member when said terminal member is properly positioned in said connector body;

a base of said terminal member, wherein said blade is on said base and said contact face is disposed between said blade, and said base; and at least one groove located to retain the inserted insulated wire, wherein said groove positions the insulated wire in said wire loader to compress the insulated wire against said blade to expose the conductive portion of the inserted insulated wire and compress said the conductive portion against said contact face.

12. A modular connector of claim 7 further comprising:

a connector locking tab;

a first side of said connector body, said connector locking tab positioned on said first side; and a chamber in said connector body, said chamber dimensioned to accept said wire loader.

13. A modular connector of claim 12 further comprising:

a second side of said connector body, said chamber positioned in said second side, wherein said wire loader is configured to slidably position said inserted insulated wire against said blade to strip insulation of said inserted insulated wire.

14. A modular connector of claim 12 further comprising:

an end of said connector body, said chamber positioned in said end, wherein said wire loader is configured to facilitate the compression of the inserted insulated wire against said blade to make electrical communication with said contact face.

15. A modular connector comprising:

a connector body;

a compressive insert wherein said insert is slidably disposed within the connector body;

at least one hole within the compressive insert that is dimensioned to receive an insulated wire;

at least one alignment groove adjacent to the at least one hole, said groove dimensioned to receive the insulated wire; and at least one contact member, said contact member having at least one blade and at least one terminal, said contact member is positioned within the main connector body adjacent said compressive insert, wherein said compressive insert compresses the insulated wire against the contact.

16. A modular connector of claim 15 wherein said compressive insert and said contact member are oriented so that the at least one blade can shear off at least a portion of an insulation jacket from the wire when the compressive insert is engaged.

17. A modular connector of claim 15 further comprising:

a locking connector tab, said tab affixed to said connector body; and an output end of the connector wherein at least eight contact members are arranged, wherein said connector body is dimension to be received by an RJ-45 style jack.

18. A modular ethernet connector comprising:

a connector body;

an insert slidably disposable within the connector body;

at least eight holes within the insert, wherein said insert is dimensioned to receive a wire having a jacket;

at least eight alignment grooves adjacent to each of the at least eight holes, said grooves dimensioned to receive the wire having the jacket;

a contact terminal, said terminal positioned within said connector body; and at least one means for electrically connecting the contact terminal to the wire having the jacket.

19. A method of forming a cable from a wire and a modular connector comprising:

providing a cable having at least one insulated wire;

providing a connector body having a chamber;

providing a wire loader having at least one hole, said hole dimensioned therein to let the at least one insulated wire pass therethrough;

providing at least one groove adjacent the at least one hole, said groove positioning the least one insulated wire;

inserting the at least one insulated wires through the at least one hole and into the at least one groove; and compressing the loader into the connector to make an electrical connection with the at least one insulated wire.

20. The method of claim 19 further comprising:

providing a portion of a strain relief section in the connector body and the loader; and trimming at least one end of the at least one of the plurality of insulated wires extending from the connector.

* * * * *

UNITED STATES PATENT AND TRADEMARK OFFICE

CERTIFICATE OF CORRECTION

PATENT NO. : 7,241,162 B1
APPLICATION NO. : 11/426069
DATED : July 10, 2007
INVENTOR(S) : Michael E. Lawrence It is certified that error appears in the above-identified patent and that said Letters Patent is hereby corrected as shown below:

Column 1
Line 34, insert a comma after “cables”

Column 2
Line 19, delete “forth” and insert -- fourth --
Line 36, delete “the least” and insert -- the at least --

Column 3
Line 32, delete “of a an” and insert -- of an --

Column 5
Line 43, delete “in”
Line 52, delete “that corresponds to” and insert -- which corresponds to --
Line 56, delete “and”
Line 67, delete “though” and insert -- through --

Column 6
Line 31, delete “connectors” and insert -- connector --
Line 52, delete “an”
Line 58, delete “ember” and insert -- member --

Column 7
Line 67, delete the comma

Column 8
Line 40, insert a comma after “530”
Line 41, insert a comma after “conductive”
Line 62, delete “similar” and insert -- similarly --

Column 9
Line 8, delete “and locking” and insert -- and a locking --
Line 43, delete “(IDC s)” and insert -- (IDCs) --
Line 47, delete “IDCs” and insert -- IDC’s --

Column 10
Line 47, delete “may untwisted” and insert -- may be twisted --

Column 11
Line 7, delete “the least” and insert -- the at least --

UNITED STATES PATENT AND TRADEMARK OFFICE

CERTIFICATE OF CORRECTION

PATENT NO. : 7,241,162 B1
APPLICATION NO. : 11/426069
DATED : July 10, 2007
INVENTOR(S) : Michael E. Lawrence It is certified that error appears in the above-identified patent and that said Letters Patent is hereby corrected as shown below:

Column 12
Line 28, delete “when”

Column 14
Line 23, delete “the least” and insert -- the at least --
Line 35, delete “wire” and insert -- wires --

Signed and Sealed this

Twenty-seventh Day of May, 2008

JON W. DUDAS
*Director of the United States Patent and Trademark Office*